US007252315B2

(12) United States Patent
Liberato et al.

(10) Patent No.: US 7,252,315 B2
(45) **Date of Patent: *Aug. 7, 2007**

(54) SYSTEM AND METHOD FOR PERSONNEL TRANSFER

(75) Inventors: Frank Liberato, Portland, TX (US); Paul Liberato, Sugar Land, TX (US)

(73) Assignee: Pugh Acquisition Co., Corpus Christi, TX (US)

( * ) Notice: Subject to any disclaimer, the term of this patent is extended or adjusted under 35 U.S.C. 154(b) by 317 days.

This patent is subject to a terminal disclaimer.

(21) Appl. No.: 10/839,104

(22) Filed: May 5, 2004

(65) Prior Publication Data

US 2005/0023853 A1 Feb. 3, 2005

Related U.S. Application Data

(63) Continuation-in-part of application No. 10/428,486, filed on May 2, 2003, now Pat. No. 7,121,600.

(60) Provisional application No. 60/467,874, filed on May 5, 2003.

(51) Int. Cl.
*B66C 1/12* (2006.01)

(52) U.S. Cl. ..... 294/77; 182/142

(58) Field of Classification Search ..... 294/77, 294/68.1, 68.3; 187/239; 182/10, 150; 441/80, 441/83, 87, 129; 267/140, 153; 244/137.1
See application file for complete search history.

(56) References Cited

U.S. PATENT DOCUMENTS

| | | | | | |
|---|---|---|---|---|---|
| 19,618 | A | * | 3/1858 | Burling | 441/32 |
| 2,827,325 | A | * | 3/1958 | Pugh | 294/77 |
| 3,827,745 | A | * | 8/1974 | Pugh | 294/77 |
| 5,074,382 | A | * | 12/1991 | Do | 187/239 |
| 5,549,342 | A | * | 8/1996 | Donaldson et al. | 294/77 |

* cited by examiner

*Primary Examiner*—Patrick Mackey
*Assistant Examiner*—Paul T. Chin
(74) *Attorney, Agent, or Firm*—Haynes and Boone, LLP

(57) ABSTRACT

A personnel transfer device is rrovided including a base, a top and a concentric lacings extending between the base and top. An expander post is coupled between the base and top for placing tension in the lacings extending between the base and the top. A hoist connection is provided so that the personnel transfer device may be lifted to transfer personnel therein from one place to another. The lacings are flexible when relaxed, and become taught when placed in tension. The expander post is removable so the base and top can be collapsed together for compact storage.

8 Claims, 22 Drawing Sheets

500

202
124
138
204
202
126
138
202
104
138
128
138
106
140
108
108
108
108
20
20
144
108
108
504
158
142
$L_1, L_2$
110
136
176
102
180
136
112
180
178
136
180

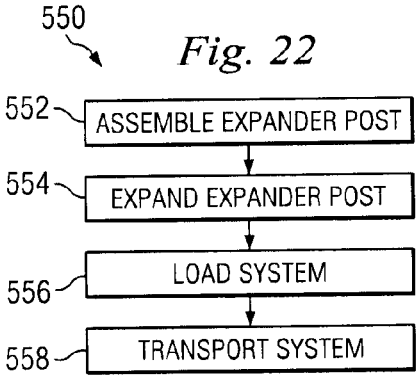
*Fig. 22*
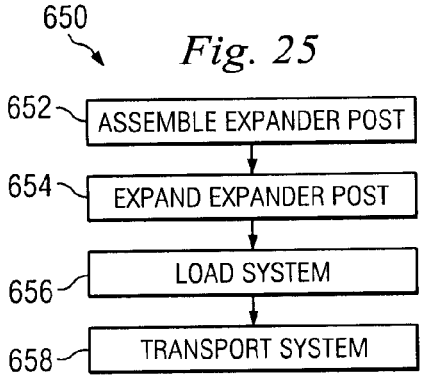
*Fig. 25*
*Fig. 24*
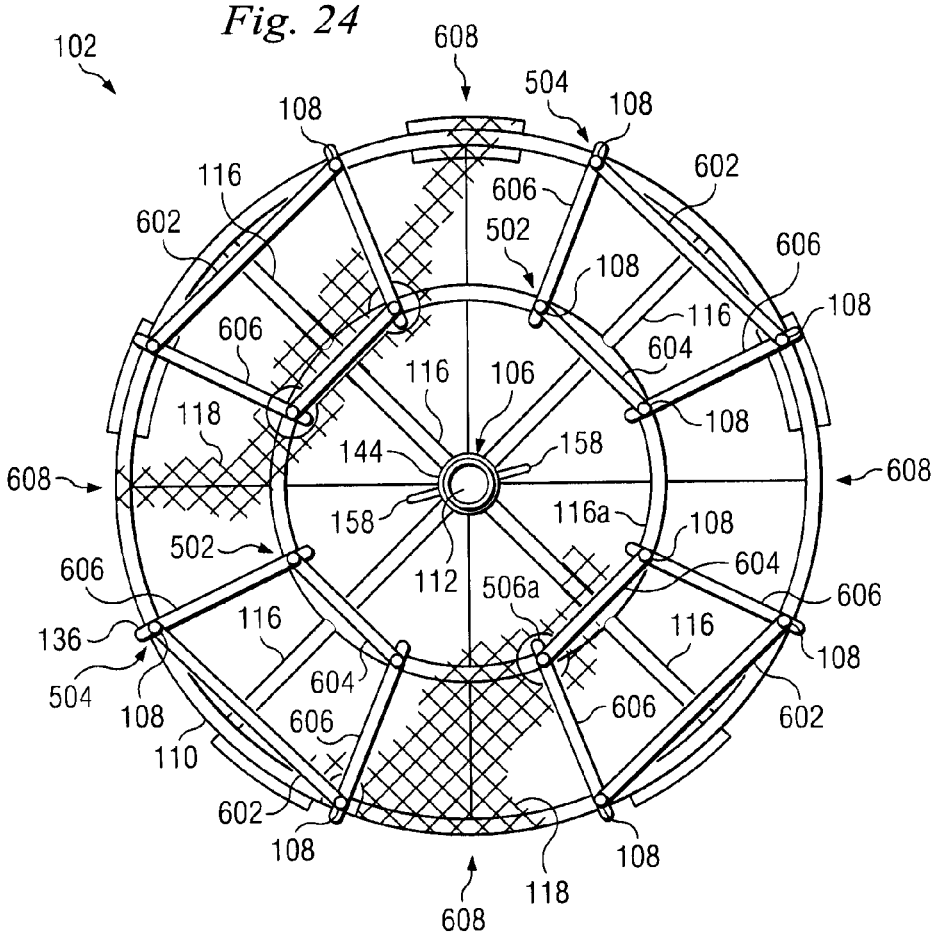

SYSTEM AND METHOD FOR PERSONNEL TRANSFER

CROSS REFERENCE TO RELATED APPLICATIONS

This application is a continuation in part of US Utility patent application Ser. No. 10/428,486, attorney docket number 33652.3, filed on May 2, 2003, now U.S. Pat. No. 7,121,600 the disclosure which is incorporated herein by reference. This application also claims the benefit of the filing date of U.S. provisional patent application Ser. No. 60/467,874, attorney docket number 33652.4, filed on May 5, 2003, the disclosure which is incorporated herein by reference.

BACKGROUND

The disclosures herein relate generally to offshore activities and more particularly to a system and method for personnel transfer to transfer personnel between offshore vessels.

Personnel nets are used in offshore activities to facilitate the transfer of personnel between entities involved in the offshore activities. These nets suffer from a host of problems, including inadequate protection for personnel in the net and instability of the net which can cause motion sickness for personnel being transferred.

Accordingly, it would be desirable to provide a system and method for transferring personnel absent the disadvantages found in the prior methods discussed above.

SUMMARY

According to one aspect of the present invention, a personnel transfer system is provided that includes a base, a top, a plurality of lacings extending between the base and top, and an expander post coupled between the base and top and operable to place tension in the plurality of lacings extending between the base and the top.

According to another aspect of the present invention, a personnel transfer system is provided that includes a base, a top, a plurality of outer lacings extending between the base and top, the outer lacings attached to the base and the top at corresponding spaced apart locations and toward the periphery of the base and the periphery of the top, a plurality of inner lacings extending between the base and the top, the inner lacings attached to the base and top at corresponding locations and toward the center of the base and the center of the top, and an expander post coupled between the base and top and operable to place tension in the plurality of outer and inner lacings extending between the base and the top.

According to another aspect of the present invention, a personnel transfer system is provided that includes a base, a top, an even number of at least four outer lacings extending between the base and top, the outer lacings attached to the base and the top at corresponding spaced apart locations and toward the periphery of the base and the periphery of the top, an even number of at least four inner lacings extending between the base and the top, the inner lacings attached to the base and top at corresponding locations and toward the center of the base and the center of the top, a first set of cross lacings extending between alternate pairs of the outer lacings so that personnel may enter the system through pairs of outer lacings without cross-lacings, a second set of cross lacings extending between alternate pairs of the inner lacings corresponding to the alternate pairs of outer lacings with the first set of cross lacings extending between them, a set of radial lacings between the inner and outer lacings which have cross lacings extending between them, and an expander post coupled between the base and top and operable to place tension in the plurality of outer and inner lacings extending between the base and the top.

According to another aspect of the present invention, an offshore vessel is provided that includes a hoist situated on the vessel and coupled to a hoist connection, and a personnel transfer system coupled to the hoist connection comprising a base, a top, a plurality of lacings extended between the base and the top, and an expander post coupled between the base and the top and operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a base, a top, a plurality of outer lacings extending between the base and top, the outer lacings attached to the base and the top at corresponding spaced apart locations and toward the periphery of the base and the periphery of the top, a plurality of inner lacings extending between the base and the top, the inner lacings attached to the base and top at corresponding locations and toward the center of the base and the center of the top, and an expander post coupled between the base and top and operable to place tension in the plurality of outer and inner lacings extending between the base and the top.

According to another aspect of the present invention, an offshore vessel is provided that includes a hoist situated on the vessel and coupled to a hoist connection, and a personnel transfer system coupled to the hoist connection comprising a base, a top, an even number of at least four outer lacings extending between the base and top, the outer lacings attached to the base and the top at corresponding spaced apart locations and toward the periphery of the base and the periphery of the top, an even number of at least four inner lacings extending between the base and the top, the inner lacings attached to the base and top at corresponding locations and toward the center of the base and the center of the top, a first set of cross lacings extending between alternate pairs of the outer lacings so that personnel may enter the system through pairs of outer lacings without cross-lacings, a second set of cross lacings extending between alternate pairs of the inner lacings corresponding to the alternate pairs of outer lacings with the first set of cross lacings extending between them, a set of radial lacings between the inner and outer lacings which have cross lacings extending between them, and an expander post coupled between the base and top and operable to place tension in the plurality of outer and inner lacings extending between the base and the top.

According to another aspect of the present invention, a method for transferring personnel is provided that includes providing a base, providing a top, providing a hoist connection coupled to the top, extending a plurality of lacings between the base and top, coupling an expander post between the base and top, expanding the expander post, whereby expansion of the expander post puts the plurality of lacings in tension, coupling a hoist to the hoist connection, situating at least one personnel on the base, and moving the hoist.

According to another aspect of the present invention, a method for transferring personnel is provided that includes providing an offshore vessel, situating a hoist on the vessel, coupling the hoist to a hoist connection, coupling the top to the hoist connection, coupling a base to the top, extending a plurality of lacings between the base and top, coupling an expander post between the base and top, expanding the expander post, whereby expansion of the expander post puts the plurality of lacings in tension, situating at least one personnel on the base, and moving the hoist.

According to another aspect of the present invention, a personnel transfer system is provided that includes a base, a top, a plurality of lacings extending between the base and top, and means coupled between the base and top for placing tension in the plurality of lacings extending between the base and the top.

According to another aspect of the present invention, a method for manufacturing a personnel transfer system is provided that includes providing a base, providing a top, extending a plurality of lacings between the base and top, coupling an expander post between the base and top, and expanding the expander post, whereby expansion of the expander post puts the plurality of lacings in tension.

According to another aspect of the present invention, a method for transferring personnel is provided that includes providing a base, providing a top including a hoist connection, extending a plurality of lacings between the base and top, coupling an expander post between the base and top, expanding the expander post, whereby expansion of the expander post puts the plurality of lacings in tension, attaching a hoist to the hoist connection, situating at least one personnel on the base, moving the hoist, protecting the personnel from above with the top, and protecting the personnel from the sides with the plurality of lacings in tension.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, a plurality of lacings extending between the top and the base and attached to the top and the base at corresponding spaced apart locations adjacent the periphery of the top and adjacent the periphery of the base, and an expander post coupled to the top coupler and the base coupler, the expander post operable to place tension in the plurality of lacings extending between the base and the top.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, a plurality of outer lacings extending between the top and the base and attached to the top and the base at corresponding spaced apart locations adjacent the periphery of the top and adjacent the periphery of the base, a plurality of inner lacings extending between the top and the base and attached to the top and the base at corresponding locations between the center of the top and between the center of the base, and an expander post coupled to the top coupler and the base coupler, the expander post operable to place tension in the plurality of lacings extending between the base and the top.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base. periphery, a base coupler coupled to the base support structure, an even number of at least four outer lacings extending between the top and the base and attached to the top and the base at corresponding spaced apart locations adjacent the periphery of the top and adjacent the periphery of the base, a plurality of outer cross lacings extending between alternating pairs of the at least four outer lacings, whereby personnel may enter the system through pairs of outer lacings without outer cross-lacings, an even number of at least four inner lacings extending between the top and the base and attached to the top and the base at corresponding locations between the center of the top and between the center of the base, a plurality of inner cross lacings extending between alternating pairs of the at least four inner lacings, whereby personnel may enter the system through pairs of inner lacings without inner cross-lacings, a plurality of radial lacings extending between the inner lacings and the outer lacings, and an expander post coupled to the top coupler and the base coupler, the expander post operable to place tension in the plurality of lacings extending between the base and the top.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a plurality of lanyards coupled to the top, a base including a platform and a base periphery, a base support structure coupled to the base, a buoyant padding covering the base periphery, a base coupler coupled to the base support structure, an even number of at least four outer lacings extending between the top and the base and attached to the top and the base at corresponding spaced apart locations adjacent the periphery of the top and adjacent the periphery of the base, a plurality of upper outer cross lacings extending between alternating pairs of the at least four outer lacings, whereby personnel may enter the system through pairs of outer lacings without upper outer cross-lacings, a plurality of lower outer cross lacings extending between alternating pairs of the at least four outer lacings, whereby personnel may enter the system through pairs of outer lacings without lower outer cross-lacings, an even number of at least four-inner lacings extending between the top and the base and attached to the top and the base at corresponding locations between the center of the top and between the center of the base, a plurality of upper inner cross lacings extending between alternating pairs of the at least four inner lacings, whereby personnel may enter the system through pairs of inner lacings without upper inner cross-lacings, a plurality of lower inner cross lacings extending between alternating pairs of the at least four inner lacings, whereby personnel may enter the system through pairs of inner lacings without lower inner cross-lacings, a plurality of radial lacings extending between the inner lacings and the outer lacings, and an expander post coupled to the top coupler and the base coupler, the expander post operable to place tension in the plurality of lacings extending between the base and the top.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a plurality of lanyards coupled to the top, a base including a platform and a base periphery, a base support structure coupled to the base, a buoyant padding covering the base periphery, a base coupler coupled to the base support structure, a plurality of outer lacings extending between the top and the base and attached to the top and the base at corresponding spaced apart locations adjacent the periphery of the top and adjacent the periphery of the base, a plurality of inner lacings extending between the top and the base and attached to the top and the base at corresponding locations between the center of the top and between the center of the base, at least one cargo net extending between the inner lacings and the outer lacings, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a top including a roof and a top periphery, a top support structure coupled to the top, a top coupler coupled to the top support structure, a buoyant padding covering the top periphery, a base coupled to the top, the base including a platform and a base periphery, a base support structure coupled to the base, a buoyant padding covering the base periphery, a base coupler coupled to the base support structure, a plurality of lacings extending between the top and the base and attached to the top and the base at corresponding spaced apart locations adjacent the periphery of the top and adjacent the periphery of the base, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, a plurality of outer lacings extending between the top and the base and attached to the top and the base at corresponding spaced apart locations adjacent the periphery of the top and adjacent the periphery of the base, a plurality of inner lacings extending between the top and the base and attached to the top and the base at corresponding locations between the center of the top and between the center of the base, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, an even number of at least four outer lacings extending between the top and the base and attached to the top and the base at corresponding spaced apart locations adjacent the periphery of the top and adjacent the periphery of the base, a plurality of outer cross lacings extending between alternating pairs of the at least four outer lacings, whereby personnel may enter the system through pairs of outer lacings without outer cross-lacings, an even number of at least four inner lacings extending between the top and the base and attached to the top and the base at corresponding locations between the center of the top and between the center of the base, a plurality of inner cross lacings extending between alternating pairs of the at least four inner lacings, whereby personnel may enter the system through pairs of inner lacings without inner cross-lacings, a plurality of radial lacings extending between the inner lacings and the outer lacings, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising, a top including a roof and a top periphery, a hoist connection coupled to the top, a top support structure coupled to the top, a top coupler coupled to the top support structure, a buoyant padding covering the top periphery, a plurality of lanyards coupled to the top, a base including a platform and a base periphery, a base support structure coupled to the base, a buoyant padding covering the base periphery, a base coupler coupled to the base support structure, an even number of at least four outer lacings extending between the top and the base and attached to the top and the base at corresponding spaced apart locations adjacent the periphery of the top and adjacent the periphery of the base, a plurality of upper outer cross lacings extending between alternating pairs of the at least four outer lacings, whereby personnel may enter the system through pairs of outer lacings without upper outer cross-lacings, a plurality of lower outer cross lacings extending between alternating pairs of the at least four outer lacings, whereby personnel may enter the system through pairs of outer lacings without lower outer cross-lacings, an even number of at least four inner lacings extending between the top and the base and attached to the top and the base at corresponding locations between the center of the top and between the center of the base, a plurality of upper inner cross lacings extending between alternating pairs of the at least four inner lacings, whereby personnel may enter the system through pairs of inner lacings without upper inner cross-lacings, a plurality of lower inner cross lacings extending between alternating pairs of the at least four inner lacings, whereby personnel may enter the system through pairs of inner lacings without lower inner cross-lacings, a plurality of radial lacings extending between the inner lacings and the outer lacings, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a top including a roof and a top periphery, a hoist connection coupled to the top, a top support structure coupled to the top, a top coupler coupled to the top support structure, a buoyant padding covering the top periphery, a plurality of lanyards coupled to the top, a base including a platform and a base periphery, a base support structure coupled to the base, a buoyant padding covering the base periphery, a base coupler coupled to the base support structure, a plurality of outer lacings extending between the top and the base and attached to the top and the base at corresponding spaced apart locations adjacent the periphery of the top and adjacent the periphery of the base, a plurality of inner lacings extending between the top and the base and attached to the top and the base at corresponding locations between the center of the top and between the center of the base, at least one cargo net extending between the inner lacings and the outer lacings, and an expander post coupled to the top coupler and the base coupler, the expander post operable to place tension in the plurality of lacings extending between the base and the top.

According to another aspect of the present invention, a method for transferring personnel is provided that includes providing a base, providing a top, coupling a hoist connection to the top, extending a plurality of lacings between the base and top, coupling an expander post between the base and top, expanding the expander post, whereby expansion of the expander post puts the plurality of lacings in tension, coupling a hoist to the hoist connection, situating at least one personnel on the base, protecting the at least one personnel with the plurality of lacings in tension, and moving the hoist.

According to another aspect of the present invention, a method for transferring personnel is provided that includes providing an offshore vessel, situating a hoist on the vessel, coupling the hoist to a hoist connection, coupling the top to the hoist connection, coupling a base to the top, extending a plurality of lacings between the base and top, coupling an expander post between the base and top, expanding the expander post, whereby expansion of the expander post puts the plurality of lacings in tension, situating at least one personnel on the base, protecting the at least one personnel with the plurality of lacings in tension, and moving the hoist.

According to another aspect of the present invention, a personnel transfer system is provided that includes a top including a roof and a top periphery, means for attaching to a lifting mechanism coupled to the top, a top support structure coupled to the top, a first means for coupling coupled to the top support structure, means for providing buoyancy and shock absorption covering the top periphery, a base including a platform and a base periphery, a base support structure coupled to the base, means for providing buoyancy and shock absorption covering the base periphery, a second means for coupling coupled to the base support structure, a plurality of lacings extending between the top and the base and attached to the top and the base at corresponding spaced apart locations adjacent the periphery of the top and adjacent the periphery of the base, and means for providing tension in the plurality of lacings coupled to the first means for coupling and the second means for coupling.

BRIEF DESCRIPTION OF THE DRAWINGS

FIG. 22 is a schematic view illustrating an exemplary embodiment of a method for transporting personnel.

FIG. 24 is a section view, illustrating an embodiment of the personnel transfer system of FIG. 23 looking down through the tension lines and expander post and onto the base.

FIG. 25 is a schematic view illustrating an exemplary embodiment of a method for transporting personnel.

DETAILED DESCRIPTION

Figure 1:
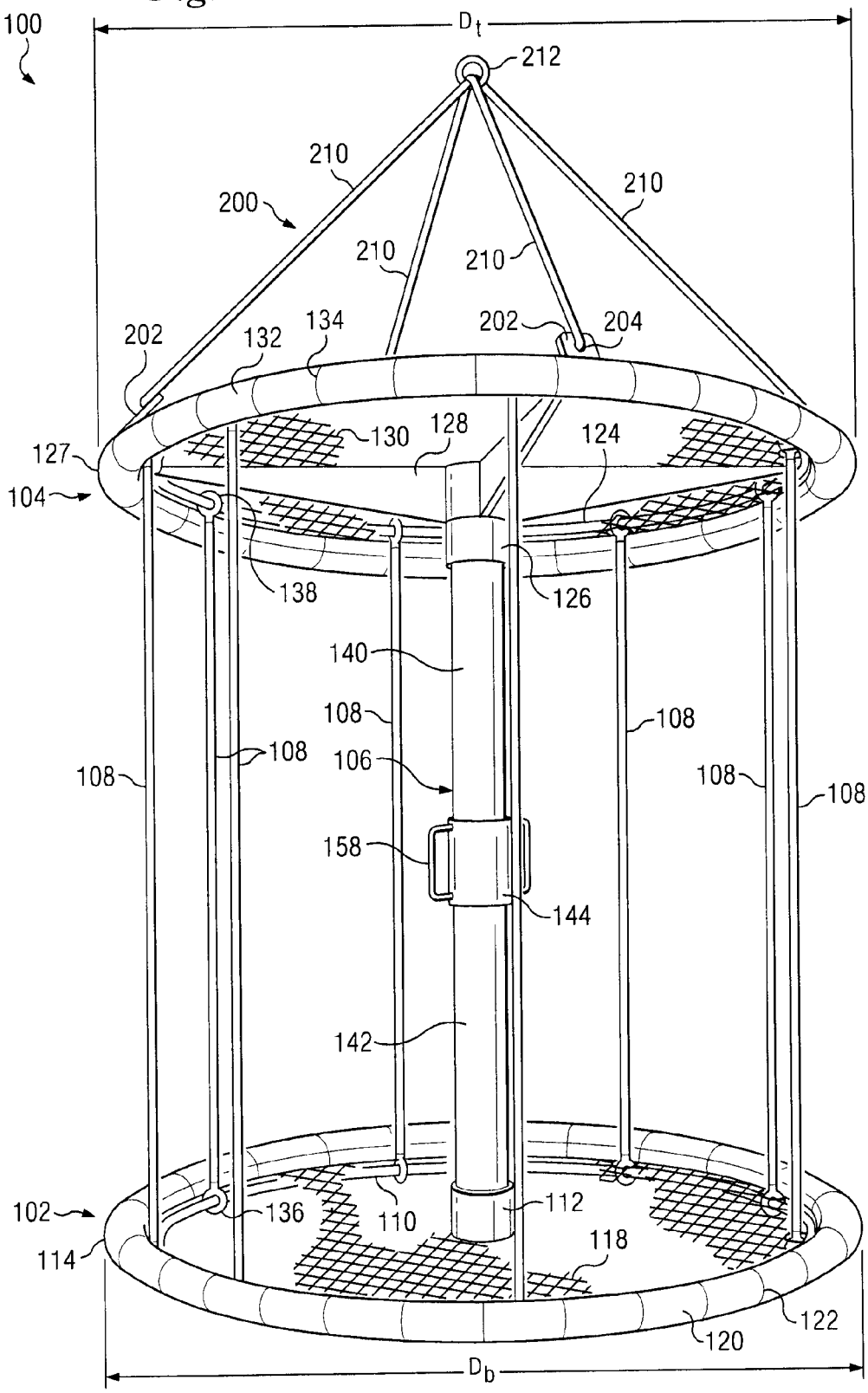
FIG. 1 is a perspective view illustrating an exemplary embodiment of a personnel transfer system.
Figure 2:
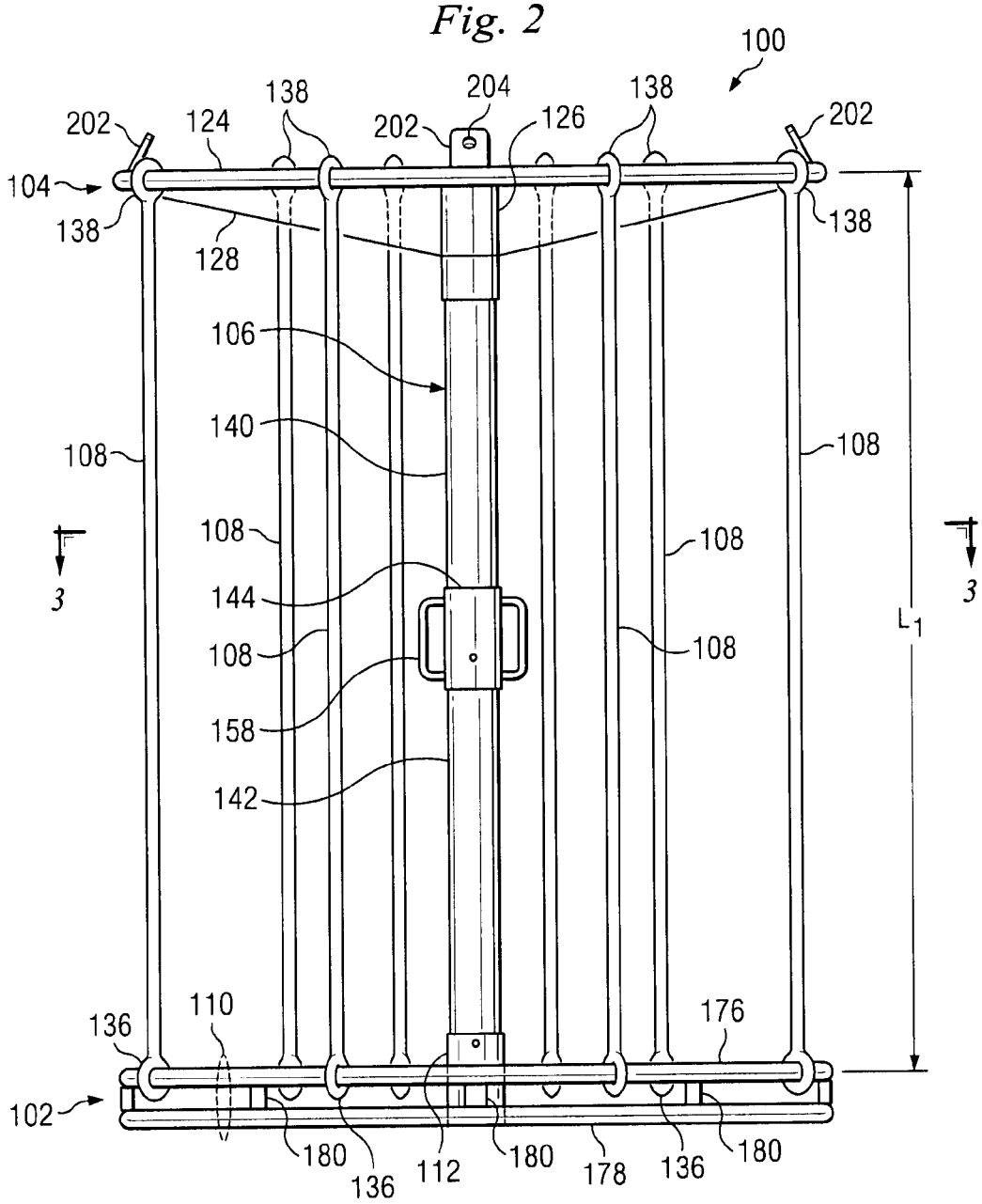
FIG. 2 is a side view illustrating an embodiment of the personnel transfer system of FIG. 1.
Figure 3:
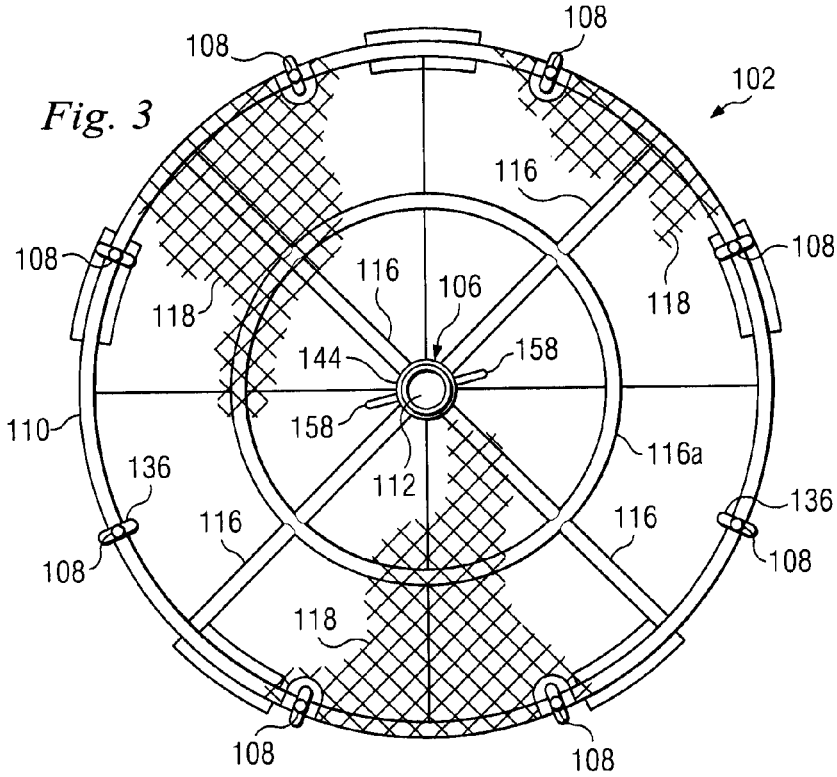
FIG. 3 is a section view, along section line 3-3 of FIG. 2, illustrating an embodiment of the personnel transfer system of FIG. 1 looking down through the tension lines and expander post and onto the base.
Figure 4:
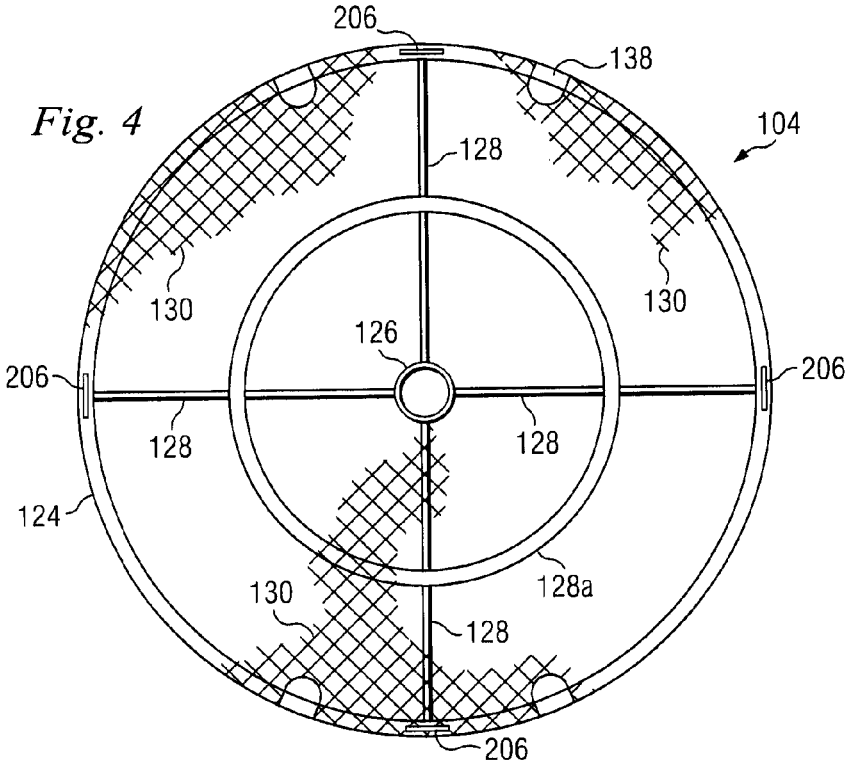
FIG. 4 is a top view illustrating an embodiment of the top of the personnel transfer system of FIG. 1.
Figure 5:
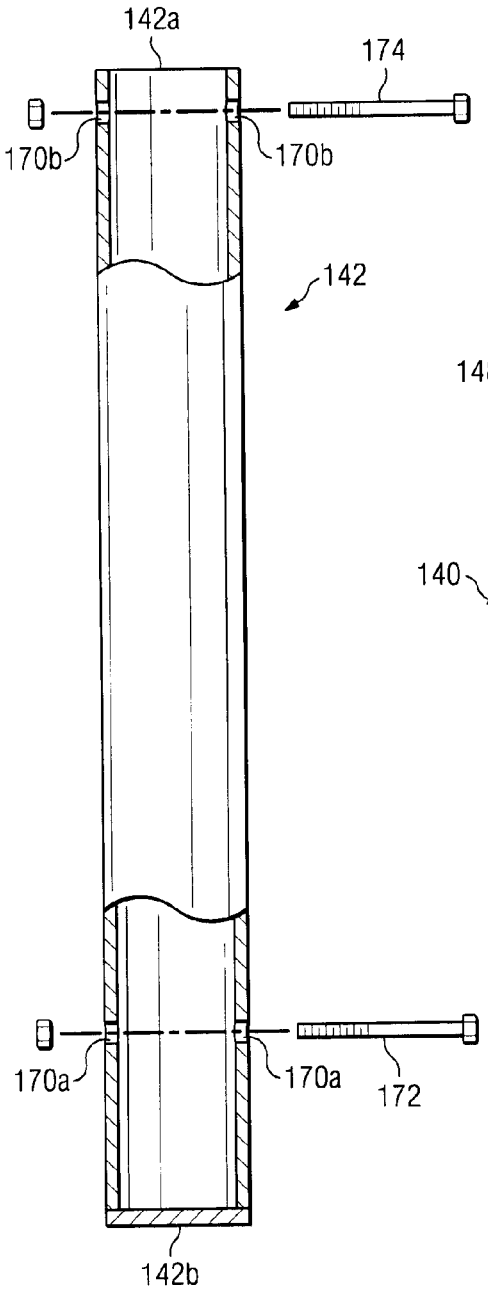
FIG. 5 is a side view with partial cutaway section illustrating an embodiment of a portion of an expander post for coupling between the base and the top of the personnel transfer system of FIG. 1.
Figure 6:
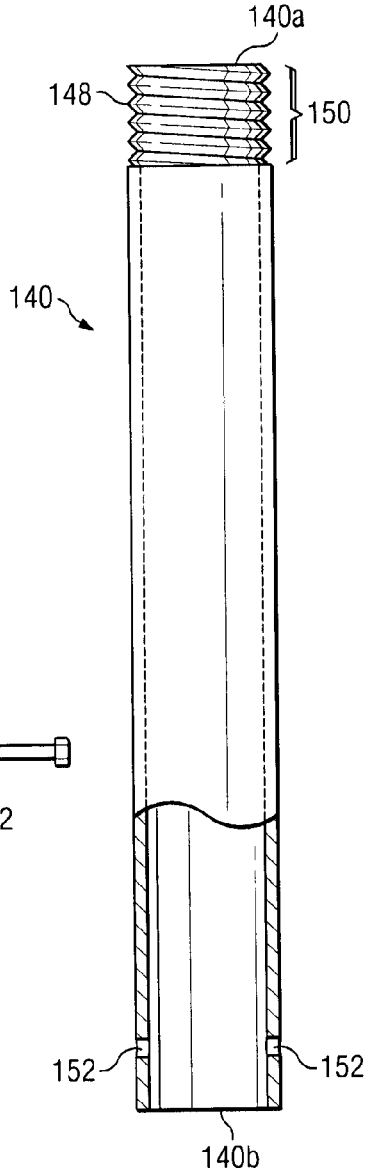
FIG. 6 is a side view with partial cutaway section illustrating an embodiment of another portion of an expander post for coupling between the base and the top of the personnel transfer system of FIG. 1.
Figure 7:
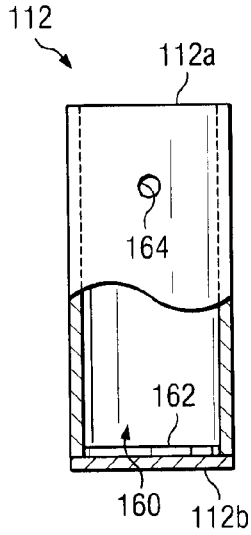
FIG. 7 is a side view with partial cutaway section illustrating an embodiment of a coupler for coupling the expander post to the base of the personnel transfer system of FIG. 1.
Figure 8:
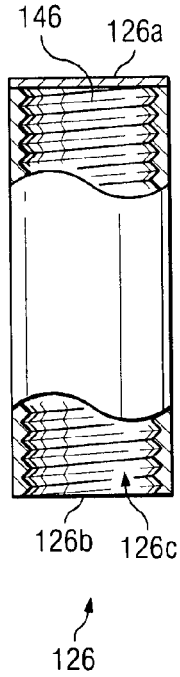
FIG. 8 is side view with partial cutaway section illustrating an embodiment of a threaded coupler for coupling the expander post to the top of the personnel transfer system of FIG. 1.
Figure 9:
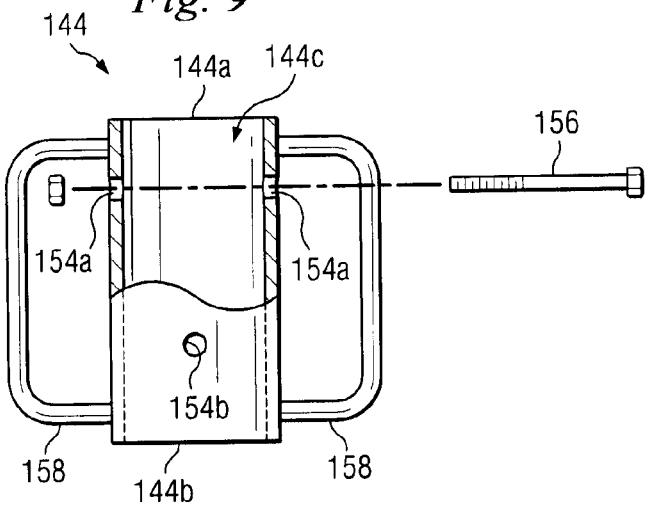
FIG. 9 is a side view with partial cutaway section illustrating an embodiment of a coupler for coupling between the portions of the expander post of FIGS. 5 and 6 in the personnel transfer system of FIG. 1.

Referring to FIGS. 1, 2, 3 and 4 of the drawings, a personnel transfer system 100 is illustrated. A base 102 is spaced apart from a top 104 by an expander post 106. A plurality of lacings 108 extend between the base 102 and the top 104.

The base 102 may include a base spreader ring 110 supporting a base coupler 112. The base spreader ring 110 has a circular shape with a periphery 114 having a diameter $D_b$ and the base coupler 112 is supported, centrally located on the base 102, by supports 116. A platform 118 is also provided extending at least partially between the base spreader ring 110 and the base coupler 112. The platform 118 is supported by the supports 116 and a base inner ring 116*a*. The periphery 114 of the base spreader ring 110 may be surrounded with a buoyant flotation padding 120. The padding 120 may be fastened to the base spreader ring 110 and covered with a durable protective covering 122.

The top 104 may also include a top spreader ring 124 supporting a top coupler 126. The top spreader ring 124 has a circular shape with a periphery 127 having a diameter $D_t$ which is approximately equal to the base diameter $D_b$. The coupler 126 is supported, centrally located on the top 104, by supports 128. A roof 130 is provided extending at least partially between the top spreader ring 124 and the coupler 126. The roof 130 is supported by the radial supports 128 and a top inner ring 128*a*. To provide added support, the radial supports 128 may be in the form of triangularly shaped plates. The periphery 127 may be surrounded with a buoyant flotation padding 132 attached to the top spreader ring 124 and covered with a durable protective covering 134.

The plurality of lacings 108 are attached between the base 102 and the top 104. The plurality of lacings 108 are positioned evenly spaced apart, with the lacings 108 attached at or near the periphery 114 of the base 102 and at or near the periphery 127 of the top 104. The lacings 108 may be flexible cords, lines, ropes, cable or like material having high strength and a low amount of stretch when placed in tension. The lacings 108 are securely fastened to the base spreader ring 110 at base attachment 136 and to the top spreader ring 124 at top attachment 138. The lacings 108 each have a length $L_1$ between base attachment 136 and top attachment 138.

The attachments of the lacings 108, at the plurality of base attachments 136 and top attachments 138, may be formed with loops around the spreader rings 110 and 124, respectively. The attachment loops at base attachment 136 and at top attachment 138 may be formed at opposed ends of the lacings 108. In an exemplary embodiment, the lacings 108 may be high strength non-stretch lacings. For example, the lacings 108 may be constructed from a high strength multi-stranded fiber material known as AMSTEEL® twelve strand, 9/16 inch diameter, high molecular weight polyethylene (12*s*, 9/16", HMWPE) available from Samson Rope Company. The Samson Rope Company rates this material as having an average strength of 30,800 lbs. Lacings 108 attached at the periphery will become taught and substantially "rigid" when placed in tension and will thereby form a barrier against side impact.

The expander post 106 includes an upper portion 140 coupled to the top 104 by top coupler 126, a lower portion 142 coupled to the base 102 by base coupler 112, and an intermediate coupler 144 situated between, and coupled to, upper portion 140 and lower portion 142.

Referring to FIGS. 1, 5, 6, 7, 8, and 9, an exemplary expander post 106 is depicted in greater detail. The expander post 106, when assembled, is coupled to the base 102 at base coupler 112 and to the top 104 at a top coupler 126. The top coupler 126 includes a closed end 126*a* coupled to the top 104, and an open end 126*b* opposite end 126*a*. The open end 126*b* provides access to a cavity 126*c*, the cavity 126*c* defined by top coupler 126 and including interior threads 146 for receiving the upper portion 140. The upper portion 140 includes an end 140*a* and an end 140*b* opposite the end 140*a*. A threaded portion 150 is provided adjacent end 140*a* of the upper portion 140 and includes exterior threads 148 that correspond to the interior threads 146 on top coupler 126. Upper portion 140 defines upper portion holes 152 adjacent end 140*b*. Intermediate coupler 144 includes an open end 144*a* and an open end 144*b* opposite end 144*a*, ends 144*a* and 144*b* providing access to a cavity 144*c* defined by the intermediate coupler 144, the cavity 144*c* for receiving the upper portion 140 and the lower portion 142.

Intermediate coupler defines intermediate coupler holes 154*a* adjacent end 144*a*. Intermediate coupler holes 154*a* are defined such that upper portion holes 152 on upper portion 140 may align with intermediate coupler holes 154*a* on intermediate coupler 144 when upper portion 140 is situated in intermediate coupler 144. A bolt 156 is provided and operable to secure upper portion 140 to intermediate coupler 144 by placing it in upper portion holes 152 and intermediate coupler holes 154*a* when the upper portion 140 is situated in the intermediate coupler 144 and the intermediate coupler holes 154*a* are aligned with the upper portion holes 152. Intermediate coupler 144 also defines intermediate coupler holes 154*b* adjacent end 144*b*, and includes handles 158 on opposite sides of the intermediate coupler 144.

The base coupler 112 includes an open end 112*a* and a closed end 112*b* opposite the end 112*a*, the closed end 112*b* coupled to the base 102. Open end 112*a* provides access to a cavity 160 defined by the base coupler 112, the cavity 160 for receiving lower portion 142. Base coupler 112 includes a friction reducing plate 162 adjacent end 112*b*, and defines base coupler holes 164 adjacent end 112*a*. Lower portion 142 includes an end 142*a* and a closed end 142*b* opposite end 142*a*. End 142*b* of lower portion 142 fits closely within cavity 160 in the base coupler 112 to provide coupling support while permitting relative rotation between the base coupler 112 and the lower portion 142. The friction reducing plate 162 facilitates relative rotation between the lower portion 142 and the base coupler 112. The friction reducing plate 162 may, for example, be constructed of a durable plastic or polymeric material or a Teflon disk. Lower portion 142 defines lower portion holes 170*a* adjacent end 142*b* which may align with base coupler holes 164 when lower portion 142 is situated in base coupler 112. A bolt 172 is operable to secure lower portion 142 to base coupler 112 by placing it in lower portion holes 170*a* and base coupler holes 112 when the lower portion 142 is situated in the base coupler 112 and the base coupler holes 164 are aligned with the lower portion holes 170*a*. Lower portion 142 also defines lower portion holes 170*b* adjacent end 142*a* which may align with intermediate coupler holes 154*b* when lower portion 142 is situated in cavity 144*c* on intermediate coupler 144. A bolt 174 is operable to secure lower portion 142 to intermediate coupler 144 by placing it in lower portion holes 170*b* and intermediate coupler holes 154*b* when the lower portion 142 is situated in the cavity 144*c* on intermediate coupler 144 and the intermediate coupler holes 154*b* are aligned with the lower portion holes 170*b*. While threading the top coupler 126 is desirable for permitting moisture to drain from the threads 146 in the top coupler 126, in an exemplary embodiment, the construction might be reversed, with base coupler 112 being threaded and the lower portion 142 of the expander post 106 being threaded, without departing from certain aspects of the present invention. Other means for expanding the expander post 106, that are equivalent to the means and function described, might also be employed without departing from certain aspects of the invention.

Referring to FIGS. 2, 3, 4, 10, 11, 12, and 15, details of construction of an exemplary embodiment of the base 102 and the top 104 is illustrated. For increased strength, light weight construction of the base spreader ring 110, and for attachment of the flotation and cushioning material, spreader ring 110 may be constructed of two tubular metal rings 176 and 178. The two tubular rings 176 and 178 are secured parallel to each other and spaced a short distance from each other by a plurality of connecter bars 180 positioned around and between the two tubular rings 176 and 178. The tubular rings 176 and 178 may be formed of a plurality of rolled tubular segments connected together as by welding or otherwise. The base inner ring 116*a* may also be constructed of a tubular metal ring. The spreader ring 110, the base inner ring 116*a* and the base coupler 112 may be connected together with base supports 116, radially positioned from the centrally located base coupler 112.

The top spreader ring 124 and top inner ring 128*a* may also be constructed of rolled tubular metal connected together and to the centrally located top coupler 126 with radial supports 128.

The tubular spreader rings 110 and 124, connector bars 180, inner rings 116*a* and 128*a*, supports 116 and 128, couplers 112 and 126, platform 118, roof 130, and other structural components may all be constructed of aluminum to provide a strong, light weight and conveniently welded construction. For added strength, and particularly for strength at interconnecting segments, the tubular rings 176 and 178 may further be provided with reinforcement bars 182, rolled inside the tubular rings 176 and 178. The platform 118 may be a plate, grating, or screen material to facilitate non-slip standing by personnel being transferred thereon, and in an exemplary embodiment, the platform 118 may include an aluminum floor plate with a rubber shock absorbing floor mat. The roof 130 may be a plate, grating, or screen material to provide protection from above for personnel in the system.

Figure 10:
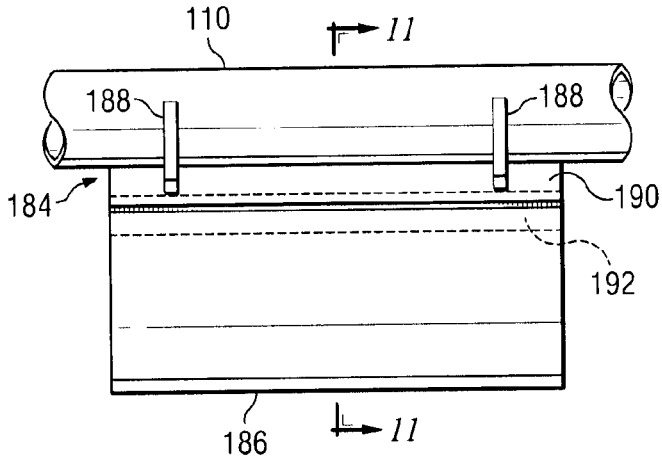
FIG. 10 is a partial side view with hidden lines illustrating an embodiment of a foot support connection of the personnel transfer system of FIG. 1.
Figure 11:
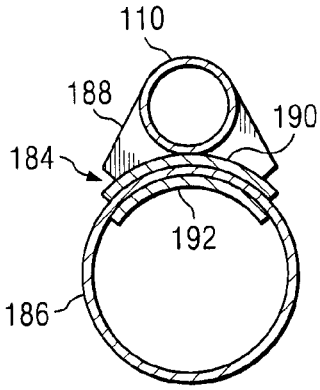
FIG. 11 is a section view illustrating an embodiment of the foot support connection of FIG. 10 taken along section line 11-11.
Figure 12:
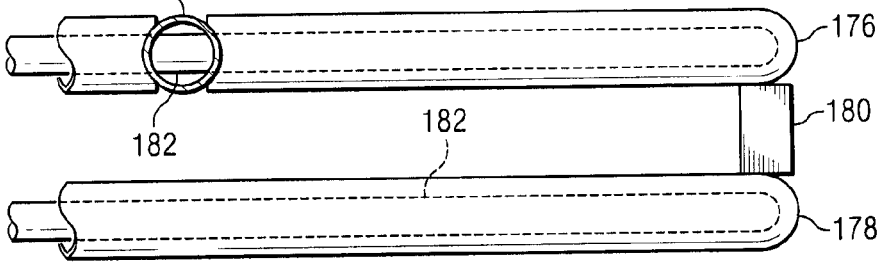
FIG. 12 is a partial side view with hidden lines illustrating an embodiment of a base ring with two tubes and interposed reinforcement bar of the personnel transfer system of FIG. 1.
Figure 13:
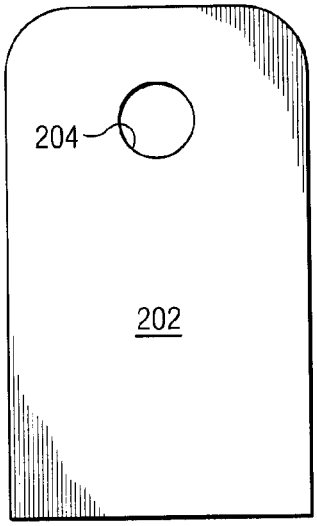
FIG. 13 is a front view illustrating an embodiment of a lift connection plate of the personnel transfer system of FIG. 1.
Figure 14:
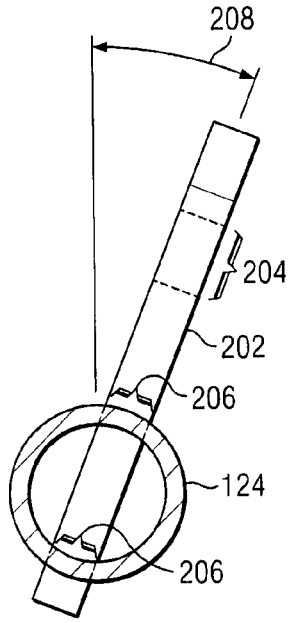
FIG. 14 is a side view illustrating an embodiment of the lift connection plate of FIG. 13 shown attached at an angle to a top spreader ring.
Figure 15:
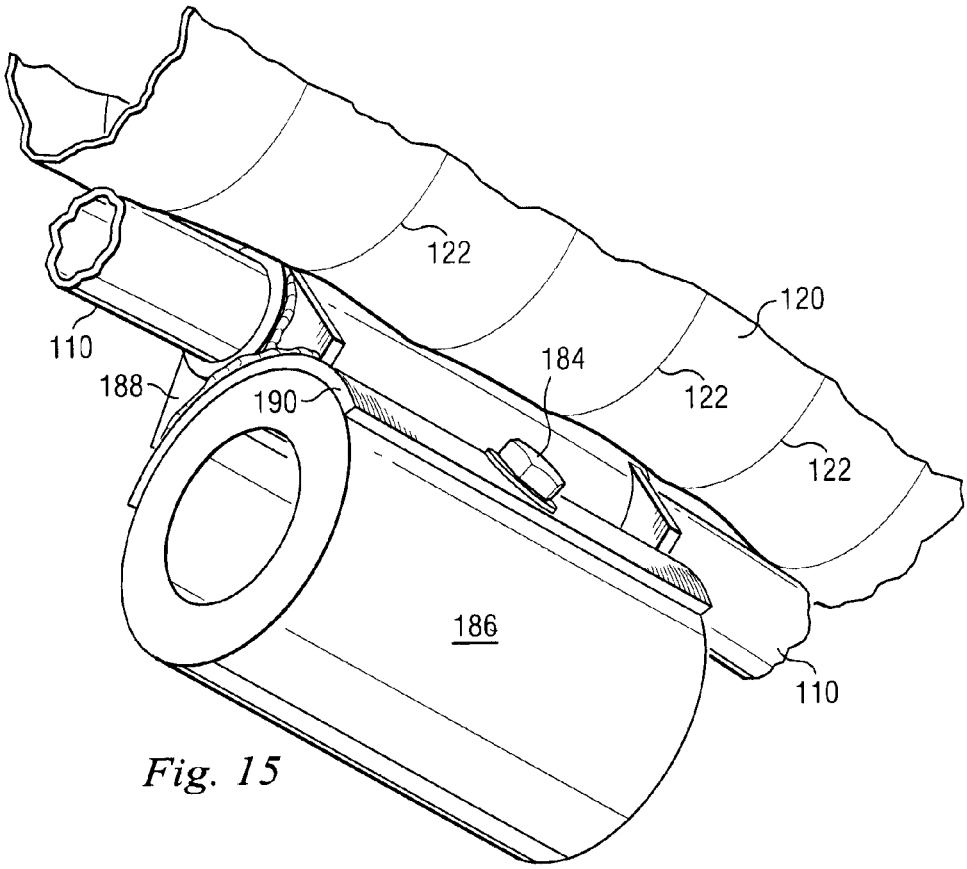
FIG. 15 is perspective view illustrating an embodiment of a foot support connection of the personnel transfer system of FIG. 1.

The base spreader ring 110 includes an attachment mechanism 184, which may be a variety of attachment mechanisms such as a weld, as illustrated in FIG. 10, or a bolt, as illustrated in FIG. 15, coupling a tubular foot support 186 to the base spreader ring 110. Tubular foot support 186 is attached by connector 188 to base spreader ring 110. The connector 188 and tubular foot support 186 may be reinforced with interposed reinforcing sections 190 and 192. A plurality of similarly constructed attachment mechanisms may be spaced around the spreader ring 110 for providing support to the system 100 when it is placed on a surface. A flexible solid cylinder of flotation material, not shown in FIGS. 10 and 11 for clarity, may be inserted and held within the tube sections 186. In an exemplary embodiment, the tubular foot support 186 includes a 3 ½ diameter, 4" long piece of tubular rubber.

Referring to FIGS. 1, 4, 13, and 14, the construction and attachment of a lift connector 200 may be seen. The lift connector 200 may be in the form of a plurality of plates 202, each plate 202 defining a hole 204 and each securely fastened into slots 206 formed in the top spreader ring 124 at an angle 208 so that a plurality of lines 210 may be attached and then connected together at a lifting link 212.

In an exemplary embodiment, during operation of the system 100, as illustrated in FIGS. 1-16, a method 300 for transferring personnel is implemented using the system 100.

Referring to FIGS. 1, 5, 6, 7, 8, 9, 16, and 17, in step 302, the expander post 106 is assembled. A hoist 400 is situated on a deck 402 of an offshore vessel 404. The hoist 400 includes a line 406. The line 406 is attached to the lifting link 212, and the top 102 is lifted and separated from the base 102 such that the lacings 108 are substantially extended. End 140*a* on upper portion 140 is brought towards end 126*b* on top coupler 126, and threaded portion 150 on upper portion 140 is threaded into cavity 126*c* on top coupler 126. In an exemplary embodiment, threaded portion 150 should be threaded into top coupler 126 such that end 140*a* on upper portion 140 is adjacent to end 126*a* on top coupler 126. End 142*b* of lower portion 142 is then brought towards end 112*a* on base coupler 112 and placed in cavity 160 on base coupler 112 so that end 142*b* comes in contact with friction reducing plate 162. Intermediate coupler 144 is brought towards end 142*a* on lower portion 142 and end 142*a* is placed in cavity 144*c* on intermediate coupler 144. Intermediate coupler 144 is then brought down over lower portion 142 such that end 144*a* on intermediate coupler 144 is below end 142*a* on lower portion 142. End 140*b* on upper portion 140 is then lined up with end 142*a* on lower portion 142 such that upper portion 140 and lower portion 142 are coaxial. Intermediate coupler 144 is then brought up lower portion 142 such that end 140*b* on upper portion 140 enters cavity 144*c* on intermediate coupler 144. Lower portion holes 170*b* are lined up with intermediate coupler holes 154*b* and upper portion holes 152 are lined up with intermediate coupler holes 154*a*. Bolt 174 is placed in intermediate coupler holes 154*b* and lower portion holes 170*b* in order to secure lower portion 142 to intermediate coupler 144. Bolt 156 is placed in intermediate coupler holes 154*a* and upper portion holes 152 in order to secure upper portion to intermediate coupler 144. The expander post 106 is now assembled and may later be disassembled and removed to allow the top 104 and the base 102 to be collapsed together for convenient storage of system 100 without removing the lacings 108.

Referring to FIGS. 1, 5, 6, 7, 8, 9, and 16, in step 304, the expander post 106 is expanded by rotating the expander post 106 by the handles 158 on intermediate coupler 144. Rotation of expander post 106 such that end 140*a* on upper portion 140 is distanced from end 126*a* on top coupler 126 causes upper portion 140 to push top coupler 126 against top 104 due to the interaction of the threads 146 and 148 on the top coupler 126 and upper portion 140, respectively. Continued rotation of expander post 106 increases the distance between the base 102 and the top 104 through contact of the expander post 106 with the top coupler 126 and the base coupler 112. The lacings 108 are attached to the base 102 and the top 104 at fixed length $L_1$, resulting in tension being placed in the lacings 108 due to the expanding of expander post 106. By rotating the threaded portion 150 on upper portion 140 of the expander post 106, the distance between the base 102 and the top 104 may then either be increased or decreased depending upon the direction of rotation. When expander post 106 has been expanded such that there is a desired tension in the lacings 108, lower portion holes 170*a* are lined up with base coupler holes 164, and bolt 172 is placed in lower portion holes 170*a* and base coupler holes 164 to secure expander post 106 in base coupler 112 and tension in the lacings 108. In order to rotate the upper portion 140 of the expander post 106, in an exemplary embodiment, either the intermediate coupler 144 should be un-secured, unbolted, or unpinned from the lower portion 142 or the lower portion 142 should be unsecured, unbolted, or unpinned from the base coupler 112 to thereby allow relative rotation of the threaded portion 150 of upper portion 140 of expander post 106 and the top coupler 126 while still keeping the expander post vertically coupled to the base 102 and the top 104. After the threaded portion 150 is rotated sufficiently to expand the distance between the top 104 and base 102 to provide the desired tension in the lacings 108, the unsecured portions of expander post 106 should then be re-secured.

The lacings 108 are of substantially equal length $L_1$ so that the base 102 and top 104 will be substantially parallel to each other when the plurality of lacings 108 are placed in tension. The lacings 108 are attached at corresponding base and top attachments 136 and 138 such that the lacings 108 are substantially parallel to each other when tension is applied to them. The lacings 108 are flexible when relaxed and become substantially rigid when tension is applied. The expander post 106 is activated to expand the space between the base 102 and the top 104 and to thereby apply tension to the lacings 108. The expander post 106 is sufficiently strong to impart a rigid connection between the base and the top and to impart significant tension to the lacings 108. For example, an aluminum tube having a nominal size of 4" schedule 80 has been found to work in one exemplary construction.

Figures 16, 17:
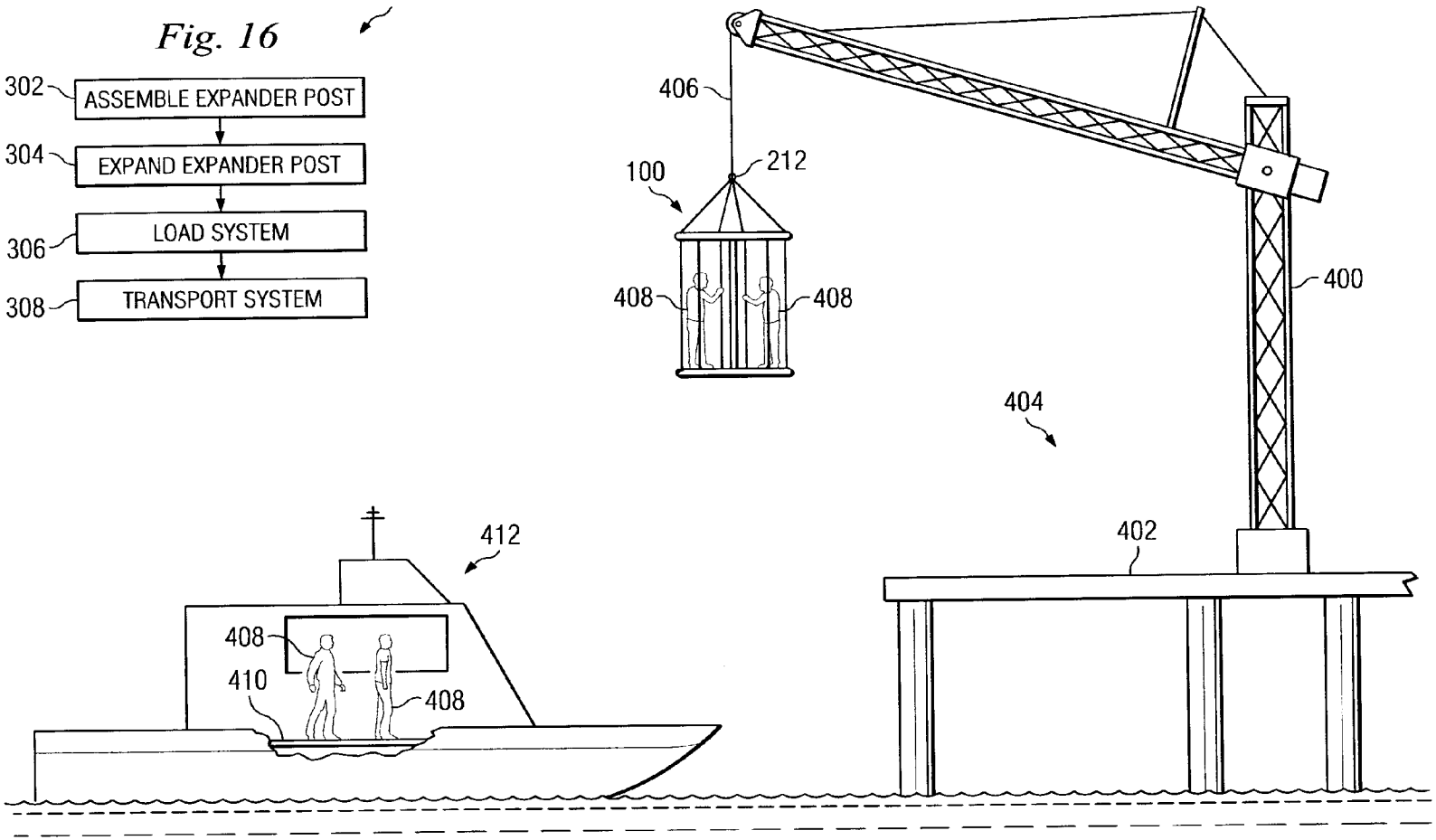
FIG. 16 is a schematic view illustrating an exemplary embodiment of a method for transporting personnel.
FIG. 17 is a side view illustrating the personnel transport system being moved between offshore vessels.

Referring to FIGS. 1, 16 and 17, in step 306, once the expander post 106 has been expanded and there is the desired tension in the lacings 108, the system 100 may be loaded with personnel 408. In one embodiment, the personnel 408 will be situated on the deck 410 of an offshore vessel 412. The hoist 400 with line 406 is attached to the system 100, and the system 100 is moved by the hoist 400 onto the deck 410 of the offshore vessel 412. The diameter $D_b$ is sufficiently large (for example 5' to 7' Dia.) to allow the personnel 408 to be carried on the platform 118. In an exemplary embodiment, the spreader ring 110, supports 116, and expander post 106 may be constructed from a strong light weight metal tubing, such as aluminum tubing, having a nominal size of 1-½" schedule 40. In an exemplary embodiment, the platform 118 may be constructed of an light weight sheet material having a non-slip surface, such as diamond plate or expanded-metal grating. All of the metal material may be constructed of the same metal to reduce the adverse effect of cathode/anode induced corrosion. Flotation paddle 120 has both significant buoyancy to help float the device and cushioning to reduce consequences from inadvertent side impact. The roof 130 allows personnel 408 loaded onto the system 100 to have protection from above when standing on the platform 118

Referring to FIGS. 16 and 17, in step 308, the system 100 may be transported. The hoist 400 lifts the system 100, which is loaded with personnel 408, and may move the personnel 408 to a desired location, such as the deck 402 of offshore vessel 404. In an exemplary embodiment, offshore vessel 412 may be a boat and offshore vessel 404 may be an offshore platform or rig.

Referring now to FIGS. 18, 19, 20 and 21, an alternative embodiment of a personnel transport system 500 is substantially identical in design and operation to personnel and cargo transport system 100 described above with reference to FIGS. 1-17, with the addition of an inner set 502 of the plurality of lacings 108 attached between the base 102 and the top 104 along with an outer set 504 of the plurality of lacings 108 attached between the base 102 and the top 104. The inner set 502 of lacings 108 are attached at base attachment 506*a* and at top attachment 506*b*, and are of a length $L_2$. The outer set 504 of lacings 108 are attached at base attachment 136 and at top attachment 138, and are of a length $L_1$. Base attachment 506*a* may be supported by base inner ring 116*a*, and top attachment 506*b* may be supported by top inner ring 128*a*.

In an exemplary embodiment, during operation of the system 500, as illustrated in FIGS. 5-15 and 17-22, a method 550 of transporting personnel is implemented using the system 500.

Referring to FIGS. 5, 6, 7, 8, 9, 17, 18 and 22, in step 552, the expander post 106 is assembled. A hoist 400 is situated on a deck 402 of an offshore vessel 404. The hoist 400 includes a line 406. The line 406 is attached to the lifting link 212, and the top 102 is lifted and separated from the base 102 such that the lacings 108 are substantially extended. End 140*a* on upper portion 140 is brought towards end 126*b* on top coupler 126, and threaded portion 150 on upper portion 140 is threaded into cavity 126*c* on top coupler 126. In an exemplary embodiment, threaded portion 150 should be threaded into top coupler 126 such that end 140*a* on upper portion 140 is adjacent to end 126*a* on top coupler 126. End 142*b* of lower portion 142 is then brought towards end 112*a* on base coupler 112 and placed in cavity 160 on base coupler 112 so that end 142*b* comes in contact with friction reducing plate 162. Intermediate coupler 144 is brought towards end 142*a* on lower portion 142 and end 142*a* is placed in cavity 144*c* on intermediate coupler 144. Intermediate coupler 144 is then brought down over lower portion 142 such that end 144*a* on intermediate coupler 144 is below end 142*a* on lower portion 142. End 140*b* on upper portion 140 is then lined up with end 142*a* on lower portion 142 such that upper portion 140 and lower portion 142 are coaxial. Intermediate coupler 144 is then brought up lower portion 142 such that end 140*b* on upper portion 140 enters cavity 144*c* on intermediate coupler 144. Lower portion holes 170*b* are lined up with intermediate coupler holes 154*b* and upper portion holes 152 are lined up with intermediate coupler holes 154*a*. Bolt 174 is placed in intermediate coupler holes 154*b* and lower portion holes 170*b* in order to secure lower portion 142 to intermediate coupler 144. Bolt 156 is placed in intermediate coupler holes 154*a* and upper portion holes 152 in order to secure upper portion to intermediate coupler 144. The expander post 106 is now assembled and may later be disassembled and removed to allow the top 104 and the base 102 to be collapsed together for convenient storage of system 500 without removing the lacings 108.

Referring to FIGS. 5, 6, 7, 8, 9, 18, and 22, in step 554, the expander post 106 is expanded by rotating the expander post 106 by the handles 158 on intermediate coupler 144. Rotation of expander post 106 such that end 140*a* on upper portion 140 is distanced from end 126*a* on top coupler 126 causes upper portion 140 to push top coupler 126 against top 104 due to the interaction of the threads 146 and 148 on the top coupler 126 and upper portion 140, respectively. Continued rotation of expander post 106 increases the distance between the base 102 and the top 104 through contact of the expander post 106 with the top coupler 126 and the base coupler 112. By rotating the threaded portion 150 on upper portion 140 of the expander post 106, the distance between the base 102 and the top 104 may then either be increased or decreased depending upon the direction of rotation. When the expander post 106 is expanded, both the inner set 502 of lacings 108 and the outer set 504 of lacings 108 are put in tension. The lengths $L_2$ of the inner set 502 of lacings 108 may be equal to or slightly greater than the lengths $L_1$ of the outer set 504 of lacings 108. In an embodiment where all the lacings 108 are of equal length, the inner set 502 of lacings will become taught and rigid, under tension created by the expander post 106 expanding the distance between the base 102 and the top 104, when the outer set 504 of lacings 108 become taught and rigid. In an embodiment where $L_2$ is greater than $L_1$ the inner set 502 of lacings 108 will be placed under some tension when the outer set 504 of lacings 108 become taught and rigid. In the embodiment where $L_2$ is greater than $L_1$, the inner set 502 of lacings 108 are useful for providing hand gripping away from the periphery 114 and 127 of the base 102 and top 104, respectively, and providing vertical support for personnel 408 on board as the system 500 is transferred. In the event of inadvertent impact from outside the system 500, any onboard personnel 408 will be shielded by the taught and rigid outer set 504 of lacings 108. When expander post 106 has been expanded such that there is a desired tension in the lacings 108, lower portion holes 170*a* are lined up with base coupler holes 164, and bolt 172 is placed in lower portion holes 170*a* and base coupler holes 164 to secure expander post 106 in base coupler 112 and tension in the lacings 108. In order to rotate the upper portion 140 of the expander post 106, in an exemplary embodiment, either the intermediate coupler 144 should be un-secured, unbolted, or unpinned from the lower portion 142 or the lower portion 142 should be unsecured, unbolted, or unpinned from the base coupler 112 to thereby allow relative rotation of the threaded portion 150 of upper portion 140 of expander post 106 and the top coupler 126 while still keeping the expander post vertically coupled to the base 102 and the top 104. After the threaded portion 150 is rotated sufficiently to expand the distance between the top 104 and base 102 to provide the desired tension in the lacings 108, the unsecured portions of expander post 106 should then be re-secured.

The lacings 108 are attached at corresponding base attachments 136 and 506*a* and top attachments 138 and 506*b* such that the lacings 108 are substantially parallel to each other when tension is applied to them. The lacings 108 are flexible when relaxed and become substantially rigid when tension is applied. The expander post 106 is activated to expand the space between the base 102 and the top 104 and to thereby apply tension to the lacings 108. The expander post 106 is sufficiently strong to impart a rigid connection between the base and the top and to impart significant tension to the lacings 108. For example, an aluminum tube having a nominal size of 4" schedule 80 has been found to work in one exemplary construction.

Figure 18:
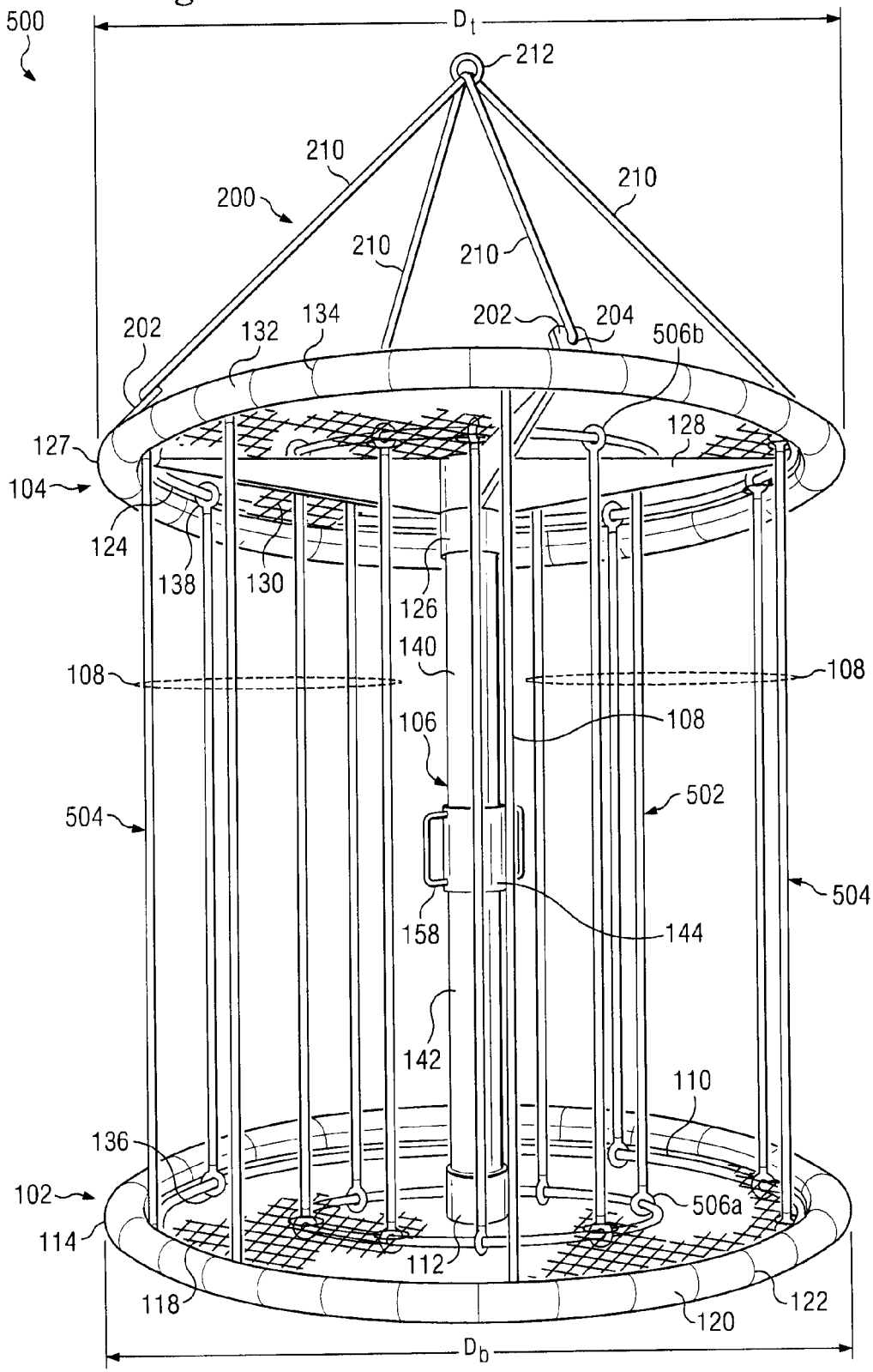
FIG. 18 is a perspective view illustrating an exemplary embodiment of a personnel transfer system.
Figure 19:
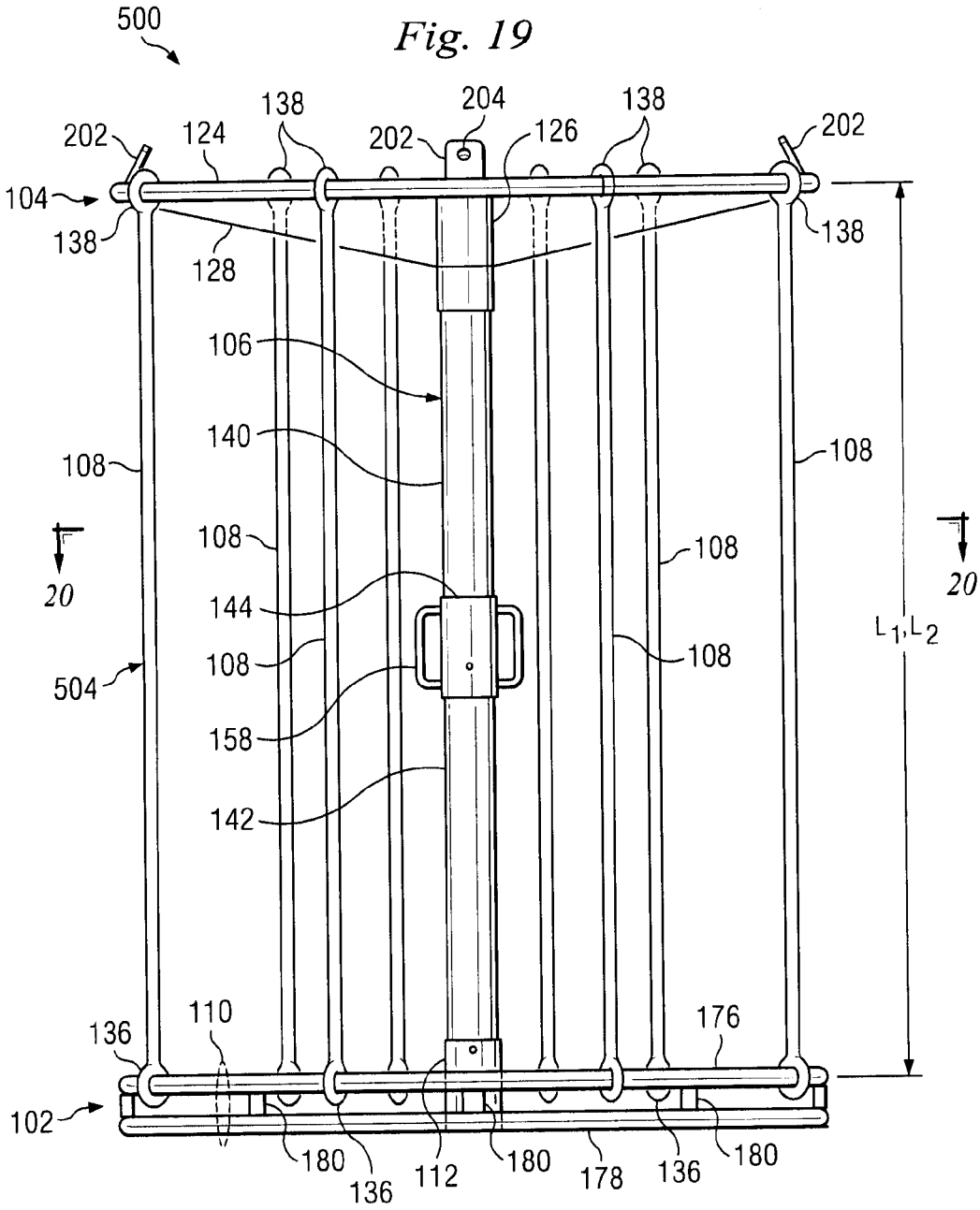
FIG. 19 is a side view illustrating an embodiment of the personnel transfer system of FIG. 18.
Figure 20:
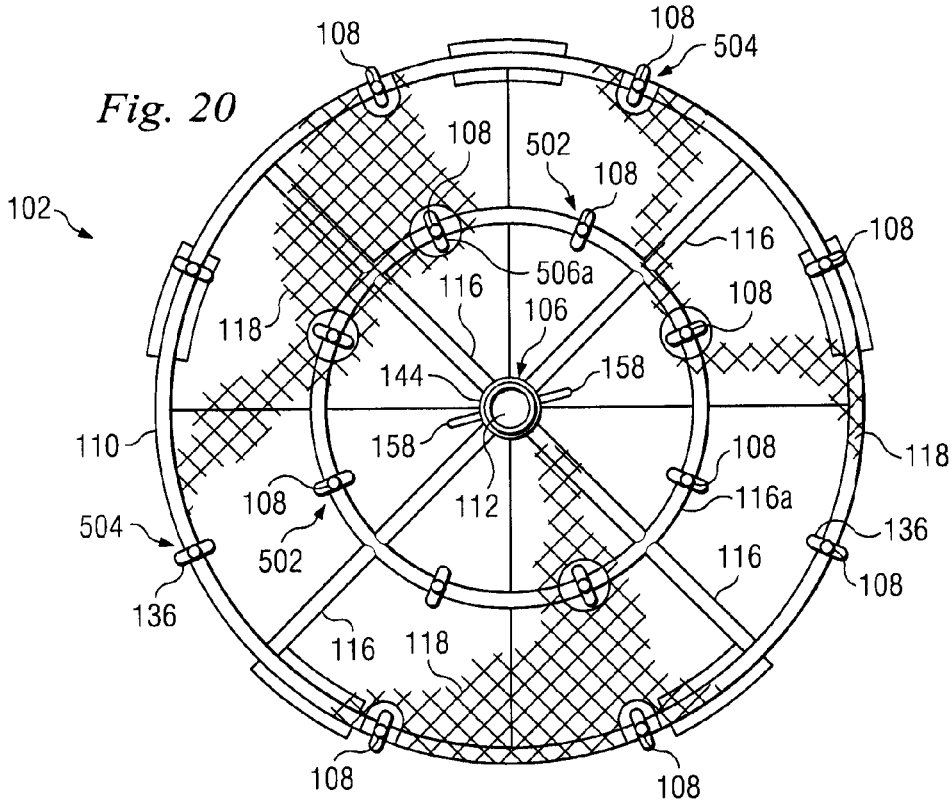
FIG. 20 is a section view, along section line 20-20 of FIG. 19, illustrating an embodiment of the personnel transfer system of FIG. 18 looking down through the tension lines and expander post and onto the base.
Figure 21:
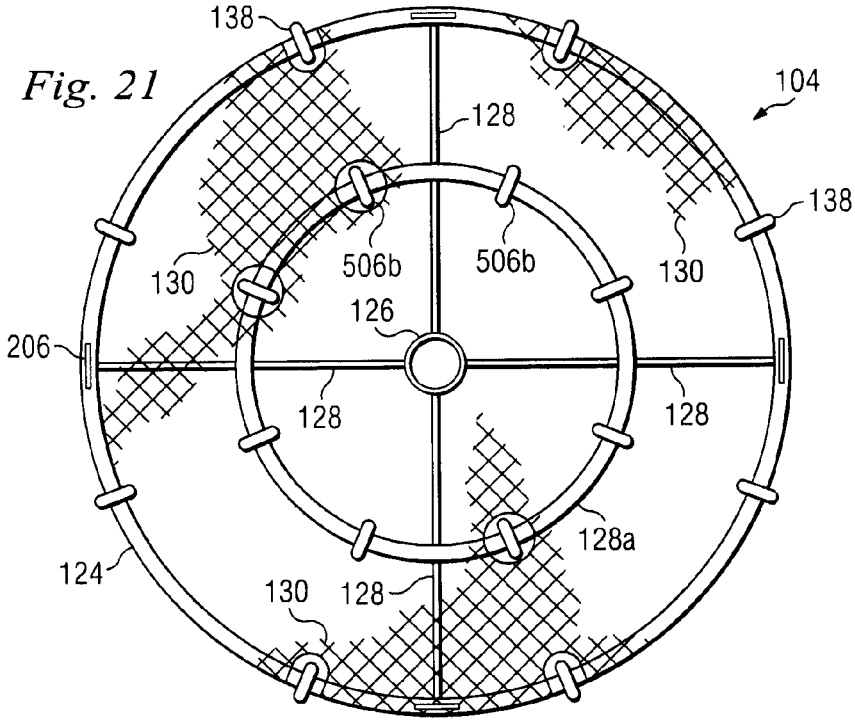
FIG. 21 is a top view illustrating an embodiment of the top of the personnel transfer system of FIG. 18.

Referring to FIGS. 17, 18 and 22, in step 556, once the expander post 106 has been expanded and there is the desired tension in the lacings 108, the system 500 may be loaded with personnel 408. In one embodiment, the personnel 408 will be situated on the deck 410 of an offshore vessel 412. The hoist 400 with line 406 is attached to the system 500, and the system 500 is moved by the hoist 400 onto the deck 410 of the offshore vessel 412. The diameter $D_b$ is sufficiently large (for example 5' to 7' Dia.) to allow the personnel 408 to be carried on the platform 118. In an exemplary embodiment, the spreader ring 110, supports 116, and expander post 106 may be constructed from a strong light weight metal tubing, such as aluminum tubing, having a nominal size of 1-½" schedule 40. In an exemplary embodiment, the platform 118 may be constructed of an light weight sheet material having a non-slip surface, such as diamond plate or expanded-metal grating. All of the metal material may be constructed of the same metal to reduce the adverse effect of cathode/anode induced corrosion. Flotation paddle 120 has both significant buoyancy to help float the device and cushioning to reduce consequences from inadvertent side impact. The roof 130 allows personnel 408 loaded onto the system 500 to have protection from above when standing on the platform 118.

Referring to FIGS. 17 and 22, in step 558, the system 500 may be transported. The hoist 400 lifts the system 500, which is loaded with personnel 408, and may move the personnel 408 to a desired location, such as the deck 402 of offshore vessel 404. In an exemplary embodiment, offshore vessel 412 may be a boat and offshore vessel 404 may be an offshore platform or rig.

Figure 23:
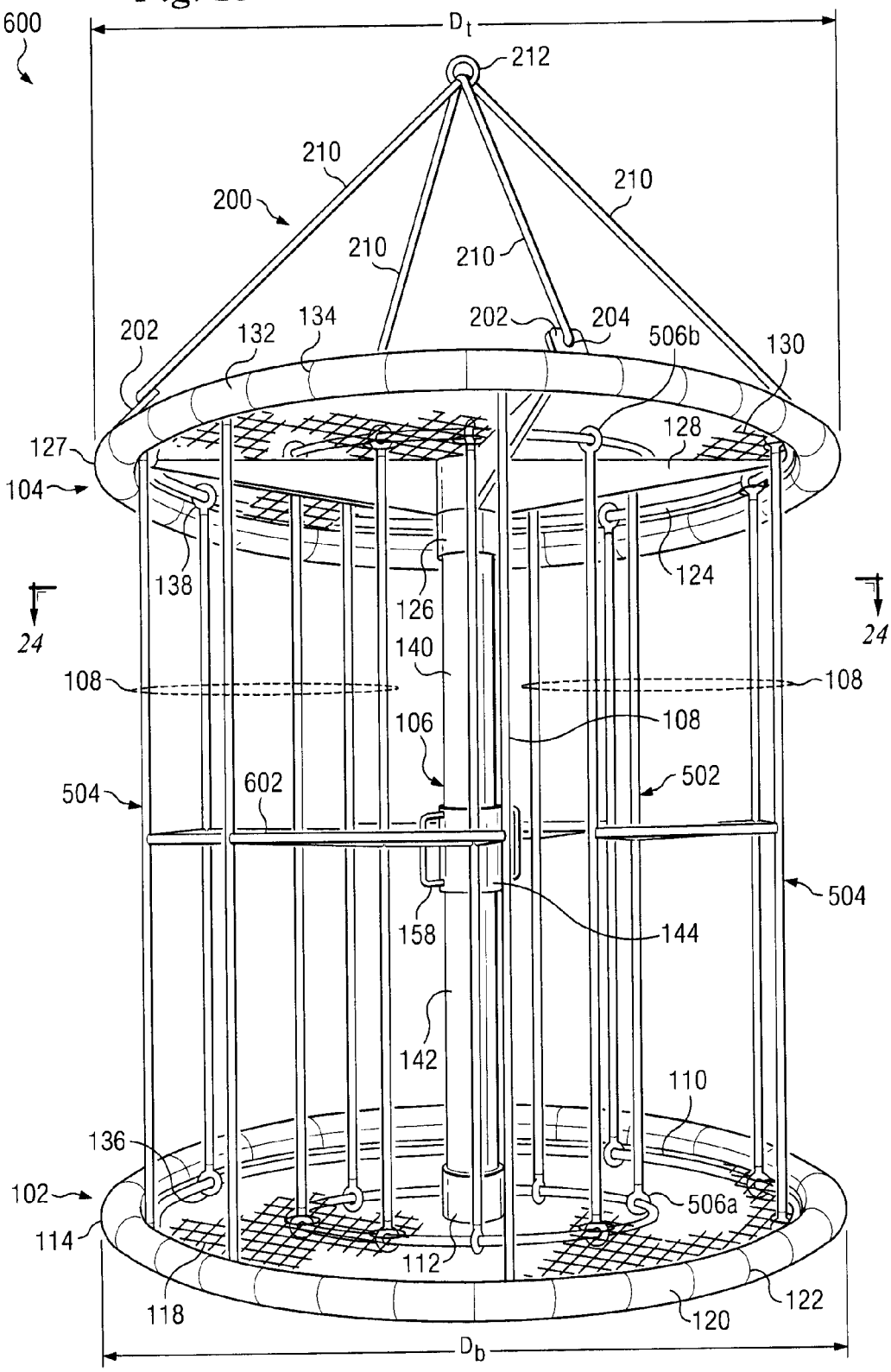
FIG. 23 is a perspective view illustrating an exemplary embodiment of a personnel transfer system.

Referring now to FIGS. 23 and 24, an alternative embodiment of a personnel transport system 600 is substantially identical in design and operation to personnel transport system 500 described above with reference to FIGS. 5-15 and 17-22, with the addition of outer cross lacings 602 interconnecting alternating pairs of the outer set 504 of lacings 108, inner cross lacings 604 interconnecting corresponding alternating pairs of the inner set 502 of lacings 108, and radial cross lacings 606 interconnecting the interconnected alternating pairs of the inner set 502 of lacings 108 and the outer set 504 of lacings 108.

In an exemplary embodiment, during operation of the system 600, as illustrated in FIGS. 5-15, 17,19, 21, and 23-25, a method 650 of transporting personnel is implemented using the system 600.

Referring to FIGS. 5, 6, 7, 8, 9, 17, 23 and 25, in step 652, the expander post 106 is assembled. A hoist 400 is situated on a deck 402 of an offshore vessel 404. The hoist 400 includes a line 406. The line 406 is attached to the lifting link 212, and the top 102 is lifted and separated from the base 102 such that the lacings 108 are substantially extended. End 140*a* on upper portion 140 is brought towards end 126*b* on top coupler 126, and threaded portion 150 on upper portion 140 is threaded into cavity 126*c* on top coupler 126. In an exemplary embodiment, threaded portion 150 should be threaded into top coupler 126 such that end 140*a* on upper portion 140 is adjacent to end 126*a* on top coupler 126. End 142*b* of lower portion 142 is then brought towards end 112*a* on base coupler 112 and placed in cavity 160 on base coupler 112 so that end 142*b* comes in contact with friction reducing plate 162. Intermediate coupler 144 is brought towards end 142*a* on lower portion 142 and end 142*a* is placed in cavity 144*c* on intermediate coupler 144. Intermediate coupler 144 is then brought down over lower portion 142 such that end 144*a* on intermediate coupler 144 is below end 142*a* on lower portion 142. End 140*b* on upper portion 140 is then lined up with end 142*a* on lower portion 142 such that upper portion 140 and lower portion 142 are coaxial. Intermediate coupler 144 is then brought up lower portion 142 such that end 140*b* on upper portion 140 enters cavity 144*c* on intermediate coupler 144. Lower portion holes 170*b* are lined up with intermediate coupler holes 154*b* and upper portion holes 152 are lined up with intermediate coupler holes 154*a*. Bolt 174 is placed in intermediate coupler holes 154*b* and lower portion holes 170*b* in order to secure lower portion 142 to intermediate coupler 144. Bolt 156 is placed in intermediate coupler holes 154*a* and upper portion holes 152 in order to secure upper portion to intermediate coupler 144. The expander post 106 is now assembled and may later be disassembled and removed to allow the top 104 and the base 102 to be collapsed together for convenient storage of system 600 without removing the lacings 108.

Referring to FIGS. 5, 6, 7, 8, 9, and 23-25, in step 654, the expander post 106 is expanded by rotating the expander post 106 by the handles 158 on intermediate coupler 144. Rotation of expander post 106 such that end 140*a* on upper portion 140 is distanced from end 126*a* on top coupler 126 causes upper portion 140 to push top coupler 126 against top 104 due to the interaction of the threads 146 and 148 on the top coupler 126 and upper portion 140, respectively. Continued rotation of expander post 106 increases the distance between the base 102 and the top 104 through contact of the expander post 106 with the top coupler 126 and the base coupler 112. By rotating the threaded portion 150 on upper portion 140 of the expander post 106, the distance between the base 102 and the top 104 may then either be increased or decreased depending upon the direction of rotation. When the expander post 106 is expanded, both the inner set 502 of lacings 108 and the outer set 504 of lacings 108 are put in tension. The lengths $L_2$ of the inner set 502 of lacings 108 may be equal to or slightly greater than the lengths $L_1$ of the outer set 504 of lacings 108. In an embodiment where all the lacings 108 are of equal length, the inner set 502 of lacings will become taught and rigid, under tension created by the expander post 106 expanding the distance between the base 102 and the top 104, when the outer set 504 of lacings 108 become taught and rigid. In an embodiment where $L_2$ is greater than $L_1$, the inner set 502 of lacings 108 will be placed under some tension when the outer set 504 of lacings 108 become taught and rigid. In the embodiment where $L_2$ is greater than $L_1$, the inner set 502 of lacings 108 are useful for providing hand gripping away from the periphery 114 and 127 of the base 102 and top 104, respectively, and providing vertical support for personnel 408 on board as the system 600 is transferred. In the event of inadvertent impact from outside the system 600, any onboard personnel 408 will be shielded by the taught and rigid outer set 504 of lacings 108. When expander post 106 has been expanded such that there is a desired tension in the lacings 108, lower portion holes 170*a* are lined up with base coupler holes 164, and bolt 172 is placed in lower portion holes 170*a* and base coupler holes 164 to secure expander post 106 in base coupler 112 and tension in the lacings 108. When the expander post 106 is expanded, the outer cross lacings 602, inner cross lacings 604, and radial cross lacings 606 provide additional stability to the system 600 and personnel 408 on the system 600. Personnel 408 may enter and exit through a plurality of gaps 608 provided by only interconnecting alternating pairs of the outer set 504 of lacings 108. In order to rotate the upper portion 140 of the expander post 106, in an exemplary embodiment, either the intermediate coupler 144 should be un-secured, unbolted, or unpinned from the lower portion 142 or the lower portion 142 should be unsecured, unbolted, or unpinned from the base coupler 112 to thereby allow relative rotation of the threaded portion 150 of upper portion 140 of expander post 106 and the top coupler 126 while still keeping the expander post 106 vertically coupled to the base 102 and the top 104. After the threaded portion 150 is rotated sufficiently to expand the distance between the top 104 and base 102 to provide the desired tension in the lacings 108, the unsecured portions of expander post 106 should then be re-secured.

The lacings 108 are attached at corresponding base attachments 136 and 506*a* and top attachments 138 and 506*b* such that the lacings 108 are substantially parallel to each other when tension is applied to them. The lacings 108 are flexible when relaxed and become substantially rigid when tension is applied. The expander post 106 is activated to expand the space between the base 102 and the top 104 and to thereby apply tension to the lacings 108. The expander post 106 is sufficiently strong to impart a rigid connection between the base and the top and to impart significant tension to the lacings 108. For example, an aluminum tube having a nominal size of 4" schedule 80 has been found to work in one exemplary construction.

Referring to FIGS. 17, 23 and 25, in step 656, once the expander post 106 has been expanded and there is the desired tension in the lacings 108, the system 600 may be loaded with personnel 408. In one embodiment, the personnel 408 will be situated on the deck 410 of an offshore vessel 412. The hoist 400 with line 406 is attached to the system 600, and the system 600 is moved by the hoist 400 onto the deck 410 of the offshore vessel 412. The diameter $D_b$ is sufficiently large (for example 5' to 7' Dia.) to allow the personnel 408 to be carried on the platform 118. In an exemplary embodiment, the spreader ring 110, supports 116, and expander post 106 may be constructed of a strong light weight metal tubing, such as aluminum tubing, having a nominal size of 1-½" schedule 40 has been found to work in one exemplary construction. The platform 118 may be constructed of an light weight sheet material having a non-slip surface, such as diamond plate or expanded-metal grating. All of the metal material may be constructed of the same metal to reduce the adverse effect of cathode/anode induced corrosion. Flotation paddle 120 has both significant buoyancy to help float the device and cushioning to reduce consequences from inadvertent side impact. The roof 130 allows personnel 408 loaded onto the system 600 to have protection from above when standing on the platform 118.

Referring to FIGS. 17 and 25, in step 658, the system 600 may be transported. The hoist 400 lifts the system 600, which is loaded with personnel 408, and may move the personnel 408 to a desired location, such as the deck 402 of offshore vessel 404. In an exemplary embodiment, offshore vessel 412 may be a boat and offshore vessel 404 may be an offshore platform or rig.

Figure 26:
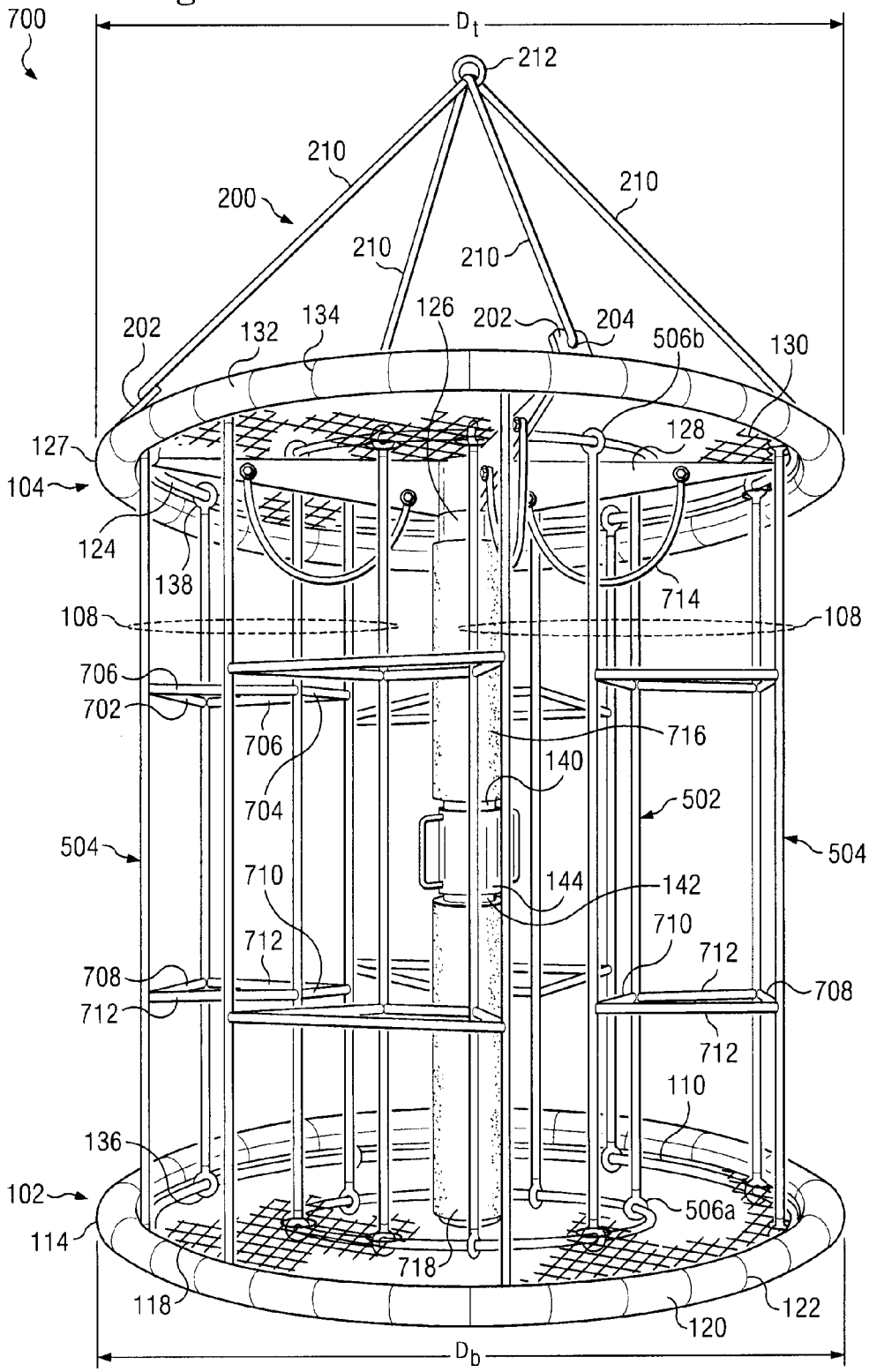
FIG. 26 is a perspective view illustrating an exemplary embodiment of a personnel transfer system.

Referring now to FIG. 26, an alternative embodiment of a personnel transport system 700 is substantially identical in design and operation to personnel transport system 600 described above with reference to FIGS. 5-15, 17,19, 21, and 23-25, with the addition of upper outer cross lacings 702 interconnecting the upper portion of alternating pairs of the outer set 504 of lacings 108, upper inner cross lacings 704 interconnecting the upper portion of alternating pairs of the inner set 502 of lacings 108, and upper radial cross lacings 706 interconnecting the interconnected alternating pairs of the upper portion of the inner set 502 of lacings 108 and the upper portion of the outer set 504 of lacings 108. Also added are lower outer cross lacings 708 interconnecting the lower portion of alternating pairs of the outer set 504 of lacings 108, lower inner cross lacings 710 interconnecting the lower portion of alternating pairs of the inner set 502 of lacings 108, and lower radial cross lacings 712 interconnecting the interconnected alternating pairs of the lower portion of the inner set 502 of lacings 108 and the upper portion of the outer set 504 of lacings 108. In addition, lanyards 714 coupled to the roof 130 may be provided, along with upper padding 716 and lower padding 718 on expansion post 106.

In an exemplary embodiment, during operation of the system 700, as illustrated in FIGS. 5-15, 17,19, 21, 24, 26, and 27, a method 750 of transporting personnel is implemented using the system 700.

Referring to FIGS. 5, 6, 7, 8, 9, 17, 26 and 27, in step 752, the expander post 106 is assembled. A hoist 400 is situated on a deck 402 of an offshore vessel 404. The hoist 400 includes a line 406. The line 406 is attached to the lifting link 212, and the top 102 is lifted and separated from the base 102 such that the lacings 108 are substantially extended. End 140*a* on upper portion 140 is brought towards end 126*b* on top coupler 126, and threaded portion 150 on upper portion 140 is threaded into cavity 126*c* on top coupler 126. In an exemplary embodiment, threaded portion 150 should be threaded into top coupler 126 such that end 140*a* on upper portion 140 is adjacent to end 126*a* on top coupler 126. End 142*b* of lower portion 142 is then brought towards end 112*a* on base coupler 112 and placed in cavity 160 on base coupler 112 so that end 142*b* comes in contact with friction reducing plate 162. Intermediate coupler 144 is brought towards end 142*a* on lower portion 142 and end 142*a* is placed in cavity 144*c* on intermediate coupler 144. Intermediate coupler 144 is then brought down over lower portion 142 such that end 144*a* on intermediate coupler 144 is below end 142*a* on lower portion 142. End 140*b* on upper portion 140 is then lined up with end 142*a* on lower portion 142 such that upper portion 140 and lower portion 142 are coaxial. Intermediate coupler 144 is then brought up lower portion 142 such that end 140*b* on upper portion 140 enters cavity 144*c* on intermediate coupler 144. Lower portion holes 170*b* are lined up with intermediate coupler holes 154*b* and upper portion holes 152 are lined up with intermediate coupler holes 154*a*. Bolt 174 is placed in intermediate coupler holes 154*b* and lower portion holes 170*b* in order to secure lower portion 142 to intermediate coupler 144. Bolt 156 is placed in intermediate coupler holes 154*a* and upper portion holes 152 in order to secure upper portion to intermediate coupler 144. The expander post 106 is now assembled and may later be disassembled and removed to allow the top 104 and the base 102 to be collapsed together for convenient storage of system 700 without removing the lacings 108.

Referring to FIGS. 5, 6, 7, 8, 9, 24, 26, and 27, in step 754, the expander post 106 is expanded by rotating the expander post 106 by the handles 158 on intermediate coupler 144. Rotation of expander post 106 such that end 140*a* on upper portion 140 is distanced from end 126*a* on top coupler 126 causes upper portion 140 to push top coupler 126 against top 104 due to the interaction of the threads 146 and 148 on the top coupler 126 and upper portion 140, respectively. Continued rotation of expander post 106 increases the distance between the base 102 and the top 104 through contact of the expander post 106 with the top coupler 126 and the base coupler 112. By rotating the threaded portion 150 on upper portion 140 of the expander post 106, the distance between the base 102 and the top 104 may then either be increased or decreased depending upon the direction of rotation. When the expander post 106 is expanded, both the inner set 502 of lacings 108 and the outer set 504 of lacings 108 are put in tension. The lengths $L_2$ of the inner set 502 of lacings 108 may be equal to or slightly greater than the lengths $L_1$ of the outer set 504 of lacings 108. In an embodiment where all the lacings 108 are of equal length, the inner set 502 of lacings will become taught and rigid, under tension created by the expander post 106 expanding the distance between the base 102 and the top 104, when the outer set 504 of lacings 108 become taught and rigid. In an embodiment where $L_2$ is greater than $L_1$ the inner set 502 of lacings 108 will be placed under some tension when the outer set 504 of lacings 108 become taught and rigid. In the embodiment where $L_2$ is greater than $L_1$, the inner set 502 of lacings 108 are useful for providing hand gripping away from the periphery 114 and 127 of the base 102 and top 104, respectively, and providing vertical support for personnel 408 on board as the system 600 is transferred. In the event of inadvertent impact from outside the system 600, any onboard personnel 408 will be shielded by the taught and rigid outer set 504 of lacings 108. When expander post 106 has been expanded such that there is a desired tension in the lacings 108, lower portion holes 170*a* are lined up with base coupler holes 164, and bolt 172 is placed in lower portion holes 170*a* and base coupler holes 164 to secure expander post 106 in base coupler 112 and tension in the lacings 108. When the expander post 106 is expanded, the cross lacings 702, 704, 708, and 710, and the radial cross lacings 706 and 712 facilitate stabilization of the lacings 108 and provide personnel 408 with additional support. Personnel 408 may enter and exit through a plurality of gaps 608 provided by only interconnecting alternating pairs of the outer set 504 of lacings 108. In order to rotate the upper portion 140 of the expander post 106, in an exemplary embodiment, either the intermediate coupler 144 should be un-secured, unbolted, or unpinned from the lower portion 142 or the lower portion 142 should be unsecured, unbolted, or unpinned from the base coupler 112 to thereby allow relative rotation of the threaded portion 150 of upper portion 140 of expander post 106 and the top coupler 126 while still keeping the expander post vertically coupled to the base 102 and the top 104. After the threaded portion 150 is rotated sufficiently to expand the distance between the top 104 and base 102 to provide the desired tension in the lacings 108, the unsecured portions of expander post 106 should then be re-secured.

The lacings 108 are attached at corresponding base attachments 136 and 506*a* and base attachments 138 and 506*b* such that the lacings 108 are substantially parallel to each other when tension is applied to them. The lacings 108 are flexible when relaxed and become substantially rigid when tension is applied. The expander post 106 is activated to expand the space between the base 102 and the top 104 and to thereby apply tension to the lacings 108. The expander post 106 is sufficiently strong to impart a rigid connection between the base and the top and to impart significant tension to the lacings 108. For example, an aluminum tube having a nominal size of 4" schedule 80 has been found to work in one exemplary construction.

Figure 27:
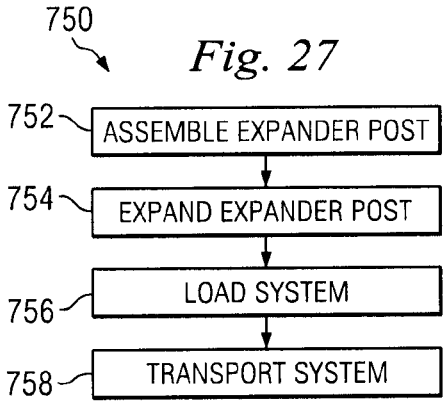
FIG. 27 is a schematic view illustrating an exemplary embodiment of a method for transporting personnel.
Figure 29:
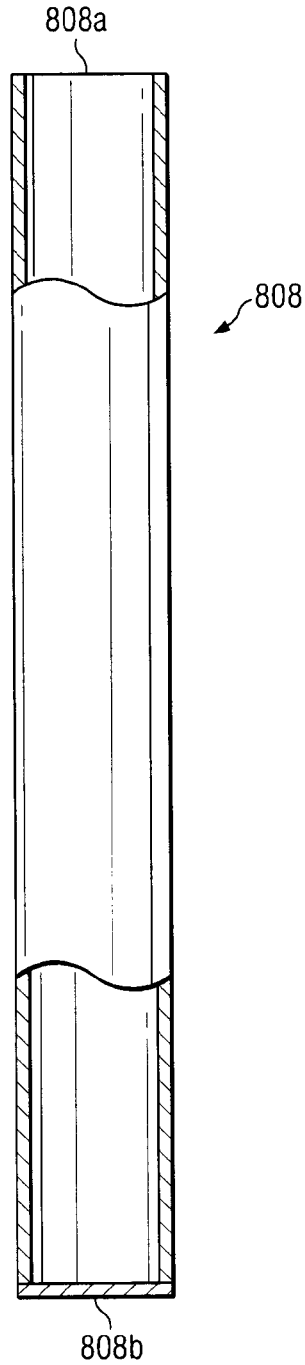
FIG. 29 is a side view with partial cutaway section illustrating an embodiment of a portion of an expander post for coupling between the base and the top of the personnel transfer system of FIG. 28.
Figure 30:
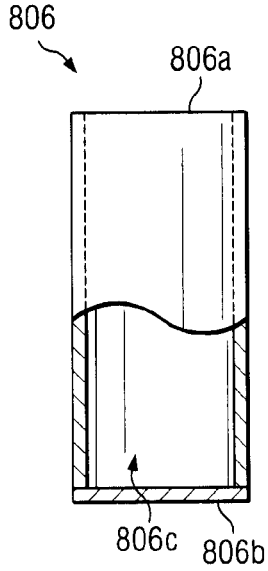
FIG. 30 is a side view with partial cutaway section illustrating an embodiment of a coupler for coupling the expander post to the base of the personnel transfer system of FIG. 28.

Referring to FIGS. 17, 26 and 27, in step 756, once the expander post 106 has been expanded and there is the desired tension in the lacings 108, the system 700 may be loaded with personnel 408. Lanyards 714 allow personnel 408 entering the system 700 the option of securing a tether line to the system 700. For example, the personnel 408 may be wearing a vest or a harness to which a quick release line may be provided for attaching to the lanyards 714. The lanyards 714 will be accessible from each of the gaps at which the personnel 408 may stand. In one embodiment, the personnel 408 will be situated on the deck 410 of an offshore vessel 412. The hoist 400 with line 406 is attached to the system 700, and the system 700 is moved by the hoist 400 onto the deck 410 of the offshore vessel 412. The diameter $D_b$ is sufficiently large (for example 5' to 7' Dia.) to allow the personnel 408 to be carried on the platform 118. In an exemplary embodiment, the spreader ring 110, supports 116, and expander post 106 may be constructed from a strong light weight metal tubing, such as aluminum tubing, having a nominal size of 1-½" schedule 40 has been found to work in one exemplary construction. In an exemplary embodiment, the platform 118 may be constructed of an light weight sheet material having a non-slip surface, such as diamond plate or expanded-metal grating. All of the metal material may be constructed of the same metal to reduce the adverse effect of cathode/anode induced corrosion. Flotation paddle 120 has both significant buoyancy to help float the device and cushioning to reduce consequences from inadvertent side impact. The roof 130 allows personnel 408 loaded onto the system 700 to have protection from above when standing on the platform 118

Referring to FIGS. 17 and 27, in step 758, the system 700 may be transported. The hoist 400 lifts the system 700, which is loaded with personnel 408, and may move the personnel 408 to a desired location, such as the deck 402 of offshore vessel 404. Upper padding 716 and lower padding 718 provide protection for personnel 408 in the system 700. In an exemplary embodiment, offshore vessel 412 may be a boat and offshore vessel 404 may be an offshore platform or rig.

Referring now to FIGS. 28, 29, 30, 31, 32, and 33, an alternative embodiment of a personnel transport system 800 is substantially identical in design and operation to personnel transport system 100 described above with reference to FIGS. 1-17, with the addition of a modified expander post 802, a modified top coupler 804 and a modified base coupler 806 replacing the expander post 106, top coupler 126, and base coupler 112 of system 100. Modified expander post 802 includes a lower portion 808, an upper portion 810, and an intermediate coupler 812. Lower portion 808 includes an end 808*a* and a closed end 808*b* opposite end 808*a*. Upper portion 810 including an end 810*a* and a closed end 810*b* opposite end 810*a*. Threaded portion 814 with threads 816 is provided adjacent end 810*a* on upper portion 810. A friction reducing plate 818 is provided adjacent end 810*b* on upper portion 810. The upper portion 810 defines upper portion holes 819 adjacent end 810*b*. Intermediate coupler 812 includes an open end 812*a* and an open end 812*b* both providing access to a cavity 812*c* defined by intermediate coupler 812. Intermediate coupler defines intermediate coupler holes 820 and provides handles 822 on opposite sides of intermediate coupler 812. Top coupler 804 includes a closed end 804*a* and an open end 804*b* opposite end 804*a*. The open end 804*b* provides access to a cavity 804*c* defined by top coupler 804, and the cavity 804*c* is provided with internal threads 824 corresponding to threads 816 on upper portion 810. Base coupler 806 includes an open end 806*a* and a closed end 806*b* opposite end 806*a*. Open end 806*a* provides access to a cavity 806*c* defined by base coupler 806.

In an exemplary embodiment, during operation of the system 800, as illustrated in FIGS. 2-4, 10-15, 17, and 28-34, a method 850 of transporting personnel is implemented using the system 800.

Referring to FIGS. 17 and 28-34, in step 852, the expander post 802 is assembled. A hoist 400 is situated on a deck 402 of an offshore vessel 404. The hoist 400 includes a line 406. The line 406 is attached to the lifting link 212, and the top 102 is lifted and separated from the base 102 such that the lacings 108 are substantially extended. End 810*a* on upper portion 810 is brought towards end 804*b* on top coupler 804, and threaded portion 814 on upper portion 810 is threaded into cavity 804*c* on top coupler 804. In an exemplary embodiment, threaded portion 814 should be threaded into top coupler 804 such that end 810*a* on upper portion 810 is adjacent to end 804*a* on top coupler 804. End 808*b* of lower portion 808 is brought towards end 806*a* on base coupler 806 and placed in cavity 806*c* on base coupler 806. Intermediate coupler 812 is brought towards end 808*a* on lower portion 808 and end 808*a* is placed in cavity 812*c* on intermediate coupler 812. Intermediate coupler 812 is then brought down over lower portion 808 such that end 812*a* on intermediate coupler 812 is below end 808*a* on lower portion 808. End 810*b* on upper portion 810 is then lined up with end 808*a* on lower portion 808 such that upper portion 810 and lower portion 808 are coaxial, with friction reducing plate 818 between them. Intermediate coupler 812 is then brought up lower portion 808 such that end 810*b* on upper portion 810 enters cavity 812*c* on intermediate coupler 812. Upper portion holes 819 are lined up with intermediate coupler holes 820. A bolt 826 is placed in intermediate coupler holes 820 and upper portion holes 819 in order to secure upper portion 810 to intermediate coupler 812. The expander post 802 is now assembled and may later be disassembled and removed to allow the top 104 and the base 102 to be collapsed together for convenient storage without removing the lacings 108.

At step 854, the expander post 802 is expanded by rotating the expander post 802 by the handles 822 on intermediate coupler 812. Rotation of expander post 802 such that end 810*a* on upper portion 810 is distanced from end 804*a* on top coupler 804 causes upper portion 810 to push top coupler 804 against top 104 due to the interaction of the threads 824 and 816 on the top coupler 804 and upper portion 810, respectively. Continued rotation of expander post 802 increases the distance between the base 102 and the top 104 through contact of the expander post 802 with the top coupler 804 and the base coupler 806. The lacings 108 are attached at fixed length $L_1$, resulting in tension being placed in the lacings 108 due to the expanding of expander post 802. By rotating the threaded portion 814 on upper portion 810 of the expander post 802, the distance between the base 102 and the top 104 may then either be increased or decreased depending upon the direction of rotation.

The lacings 108 are of substantially equal length $L_1$ so that the base 102 and top 104 will be substantially parallel to each other when the plurality of lacings 108 are placed in tension. The lacings 108 are attached at corresponding base and top attachments 136 and 138 such that the lacings 108 are substantially parallel to each other when tension is applied to them. The lacings 108 are flexible when relaxed and become substantially rigid when tension is applied. The expander post 802 is activated to expand the space between the base 102 and the top 104 and to thereby apply tension to the lacings 108. The expander post 802 is sufficiently strong to impart a rigid connection between the base and the top and to impart significant tension to the lacings 108. For example, an aluminum tube having a nominal size of 4" schedule 80 has been found to work in one exemplary construction.

Figure 28:
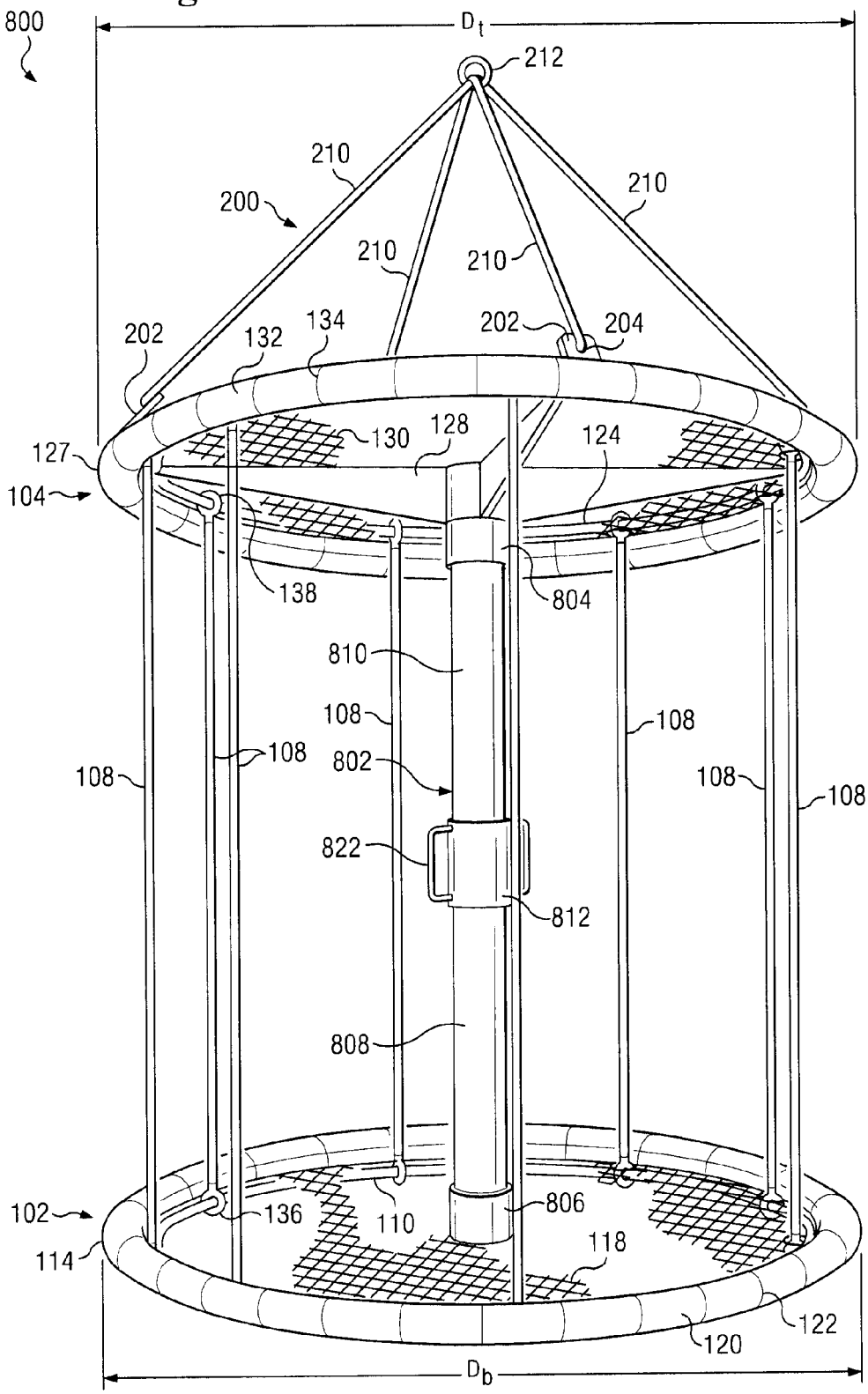
FIG. 28 is a perspective view illustrating an exemplary embodiment of a personnel transfer system.
Figure 31:
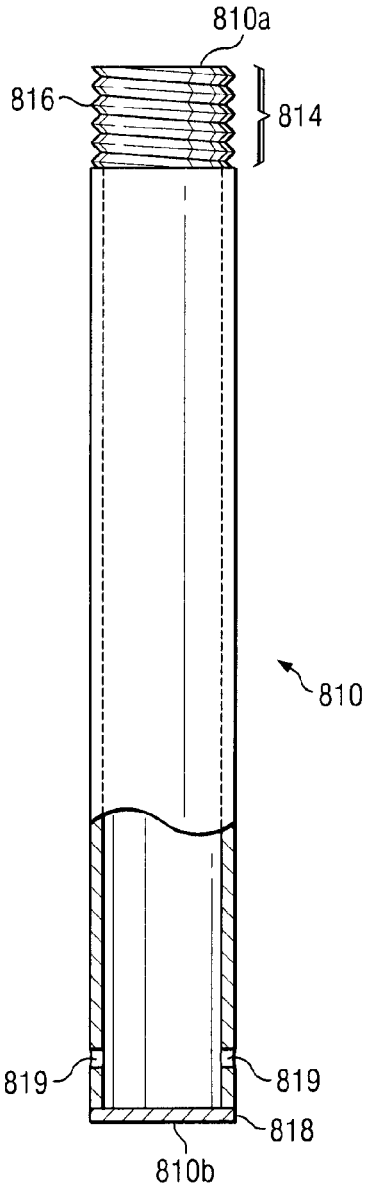
FIG. 31 is a side view with partial cutaway section illustrating an embodiment of another portion of an expander post for coupling between the base and the top of the personnel transfer system of FIG. 28.
Figure 33:
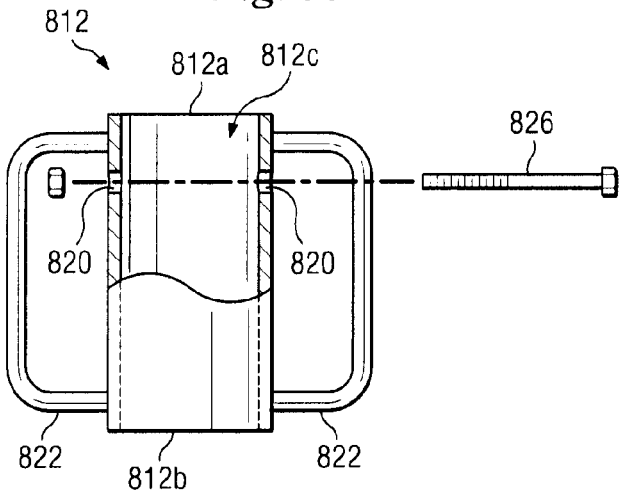
FIG. 33 is a side view with partial cutaway section illustrating an embodiment of a coupler for coupling between the portions of the expander post of FIGS. 29 and 31 in the personnel transfer system of FIG. 28.
Figure 34:
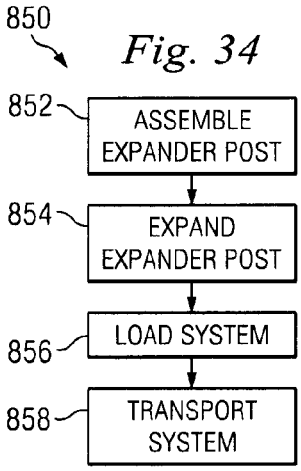
FIG. 34 is a schematic view illustrating an exemplary embodiment of a method for transporting personnel.
Figure 32:
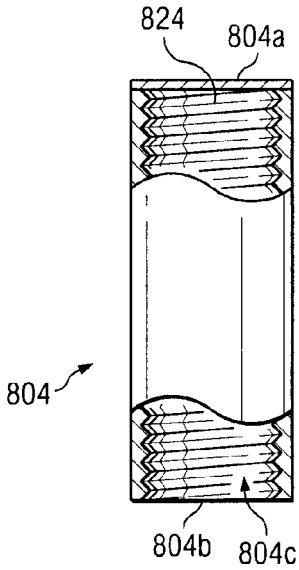
FIG. 32 is side view with partial cutaway section illustrating an embodiment of a threaded coupler for coupling the expander post to the top of the personnel transfer system of FIG. 28.

Referring to FIGS. 17, 28, and 34, in step 856, once the expander post 802 has been expanded and there is tension in the lacings 108, the system 800 may be loaded with personnel 408. In one embodiment, the personnel 408 will be situated on the deck 410 of an offshore vessel 412. The hoist 400 with line 406 is attached to the system 800, and the system 800 is moved by the hoist 400 onto the deck 410 of the offshore vessel 412. The diameter $D_b$ is sufficiently large (for example 5' to 7' Dia.) to allow the personnel 408 to be carried on the platform 118. In an exemplary embodiment, the spreader ring 110, supports 116, and expander post 106 may be constructed from a strong light weight metal tubing, such as aluminum tubing, having a nominal size of 1-½" schedule 40 has been found to work in one exemplary construction. In an exemplary embodiment, the platform 118 may be constructed of an light weight sheet material having a non-slip surface, such as diamond plate or expanded-metal grating. All of the metal material may be constructed of the same metal to reduce the adverse effect of cathode/anode induced corrosion. Flotation paddle 120 has both significant buoyancy to help float the device and cushioning to reduce consequences from inadvertent side impact. The roof 130 allows personnel 408 loaded onto the system 800 to have protection from above when standing on the platform 118.

Referring to FIGS. 17 and 34, in step 858, the system 800 may be transported. The hoist 400 lifts the system 800, which is loaded with personnel 408, and may move the personnel 408 to a desired location, such as the deck 402 of offshore vessel 404. In an exemplary embodiment, offshore vessel 412 may be a boat and offshore vessel 404 may be an offshore platform or rig.

Referring now to FIGS. 35, 36, 37, 38, 39, 40, and 41, an alternative embodiment of a personnel transport system 900 is substantially identical in design and operation to personnel transport system 500 described above with reference to FIGS. 5-15, and 17-22, with the addition of a plurality of cargo baskets 902, a plurality of lanyards 904, and a plurality of modified base attachments 906 and top attachments 908 for modified lacings 910 replacing the base attachments 136 and 406*a*, top attachments 138 and 406*b*, and lacings 108 of system 400. The plurality of cargo baskets 902 are made up of a plurality of nettings 912 extending between pairs of the outer set 504 of lacings 910, pairs of the inner set 502 of lacings 910, and radially between pairs of the inner set 502 and the outer set 504 of lacings 910 in such a manner as to close off an area of the platform 118 on base 102. The plurality of lanyards 904 are coupled to the roof 130 extending between the top spreader ring 124 and the supports 128.

In an exemplary embodiment, the plurality of lacings 910, as illustrated in FIG. 34, each include a cable 914 running the length of the lacing 910 and provided with a swaged stud 916 at each end. The cable 914 and a portion of the swaged stud 916 includes a cover 918. Swaged stud 916 extends from the cover 918, and includes a lip 920, and a terminal end 922 with threads 924. A plurality of nuts 926 are provided for threading onto the terminal end 922 of swaged stud 916. In an exemplary embodiment, cable 914 includes ¼ inch stainless steel cable, and cover 918 includes a hollow ¾ inch urethane dipped twelve strand polyester rope.

Figure 39:
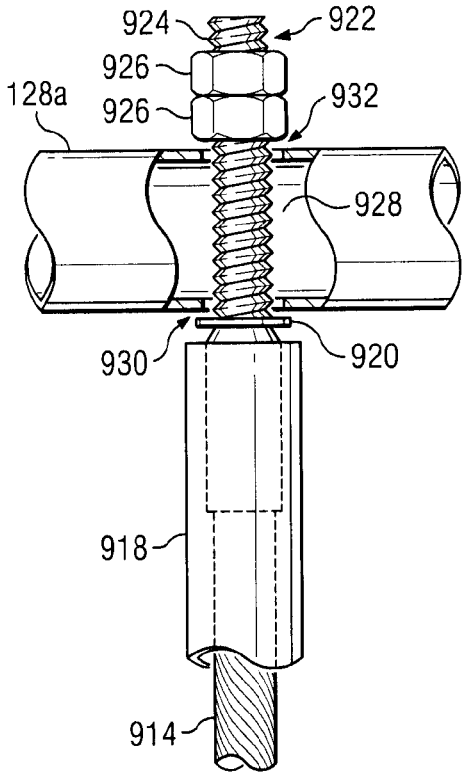
FIG. 39 is a side view illustrating an attachment of a lacing to a support structure on the personnel transfer system of FIG. 35.
Figure 40:
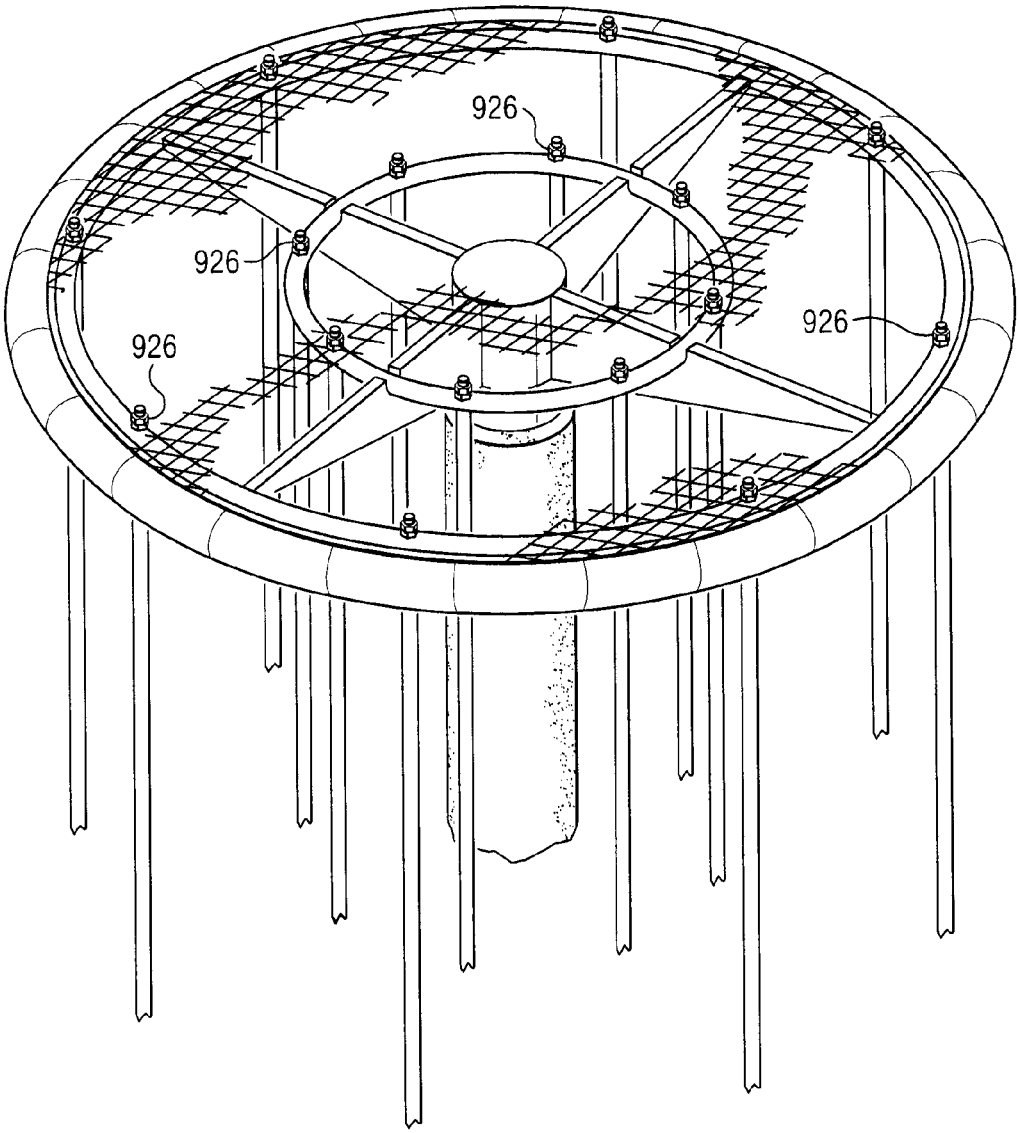
FIG. 40 is a perspective view illustrating a top section on the personnel transfer system of FIG. 35.
Figure 41:
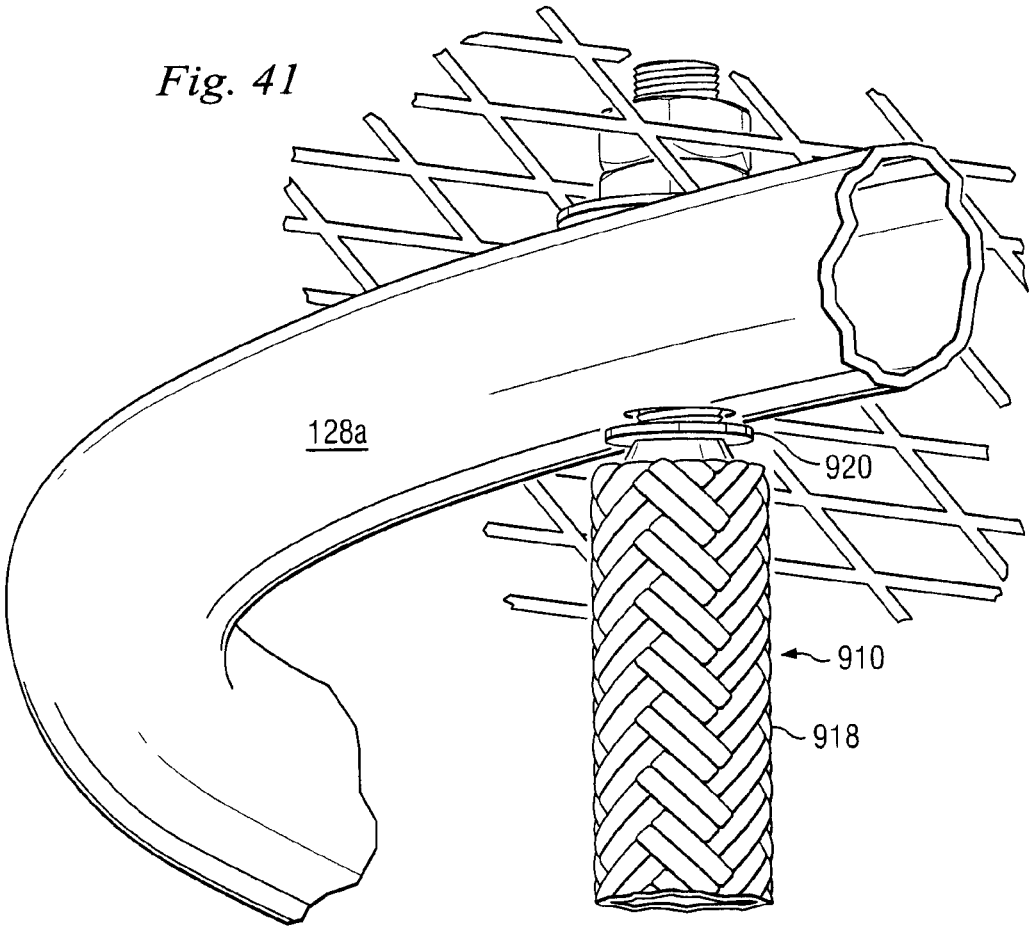
FIG. 41 is a perspective view illustrating an attachment of a lacing to a support structure on the personnel transfer system of FIG. 35.

Base attachments 906 and top attachments 908 are the same and are provided on the top spreader ring 124, top inner ring 128*a*, base spreader ring 110, and base inner ring 116*a* in spaced apart locations for attachment of the lacings 910. In an exemplary embodiment, the top attachment 908, as illustrated in FIG. 39, is provided on top inner ring 128*a*. A passageway 928 is provided through top inner ring 128*a* with an inlet 930 and an outlet 932. Lacings 910 are attached to top inner ring 128*a* by placing terminal end 922 through passageway 928 and threading nuts 926 onto threads 924. The nuts 926 may then be used to adjust the tension in the lacings 910 by tightening the nut 926 adjacent the top inner ring 128*a* to adjust the lacing 910, then locking that nut 926 down by tightening the other nut 926 when the desired tension is in the lacing 910.

In an exemplary embodiment, during operation of the system 900, as illustrated in FIGS. 5-15, 17-21, and 3542, a method 950 of transporting personnel is implemented using the system 900.

Referring to FIGS. 5, 6, 7, 8, 9, 17, 18, 35, and 42, in step 952, the expander post 106 is assembled. A hoist 400 is situated on a deck 402 of an offshore vessel 404. The hoist 400 includes a line 406. The line 406 is attached to the lifting link 212, and the top 102 is lifted and separated from the base 102 such that the lacings 910 are substantially extended. End 140*a* on upper portion 140 is brought towards end 126*b* on top coupler 126, and threaded portion 150 on upper portion 140 is threaded into cavity 126*c* on top coupler 126. In an exemplary embodiment, threaded portion 150 should be threaded into top coupler 126 such that end 140*a* on upper portion 140 is adjacent to end 126*a* on top coupler 126. End 142*b* of lower portion 142 is then brought towards end 112*a* on base coupler 112 and placed in cavity 160 on base coupler 112 so that end 142*b* comes in contact with friction reducing plate 162. Intermediate coupler 144 is brought towards end 142*a* on lower portion 142 and end 142*a* is placed in cavity 144*c* on intermediate coupler 144. Intermediate coupler 144 is then brought down over lower portion 142 such that end 144*a* on intermediate coupler 144 is below end 142*a* on lower portion 142. End 140*b* on upper portion 140 is then lined up with end 142*a* on lower portion 142 such that upper portion 140 and lower portion 142 are coaxial. Intermediate coupler 144 is then brought up lower portion 142 such that end 140*b* on upper portion 140 enters cavity 144*c* on intermediate coupler 144. Lower portion holes 170*b* are lined up with intermediate coupler holes 154*b* and upper portion holes 152 are lined up with intermediate coupler holes 154*a*. Bolt 174 is placed in intermediate coupler holes 154*b* and lower portion holes 170*b* in order to secure lower portion 142 to intermediate coupler 144. Bolt 156 is placed in intermediate coupler holes 154*a* and upper portion holes 152 in order to secure upper portion to intermediate coupler 144. The expander post 106 is now assembled and may later be disassembled and removed to allow the top 104 and the base 102 to be collapsed together for convenient storage without removing the lacings 910.

Referring to FIGS. 5, 6, 7, 8, 9, 35, and 42, in step 954, the expander post 106 is expanded by rotating the expander post 106 by the handles 158 on intermediate coupler 144. Rotation of expander post 106 such that end 140*a* on upper portion 140 is distanced from end 126*a* on top coupler 126 causes upper portion 140 to push top coupler 126 against top 104 due to the interaction of the threads 146 and 148 on the top coupler 126 and upper portion 140, respectively. Continued rotation of expander post 106 increases the distance between the base 102 and the top 104 through contact of the expander post 106 with the top coupler 126 and the base coupler 112. By rotating the threaded portion 150 on upper portion 140 of the expander post 106, the distance between the base 102 and the top 104 may then either be increased or decreased depending upon the direction of rotation. When the expander post 106 is expanded, both the inner set 502 of lacings 910 and the outer set 504 of lacings 910 are put in tension. The lengths $L_2$ of the inner set 502 of lacings 910 may be equal to or slightly greater than the lengths $L_1$ of the outer set 504 of lacings 910. In an embodiment where all the lacings 910 are of equal length, the inner set 502 of lacings will become taught and rigid, under tension created by the expander post 106 expanding the distance between the base 102 and the top 104, when the outer set 504 of lacings 910 become taught and rigid. In an embodiment where $L_2$ is greater than $L_1$, the inner set 502 of lacings 910 will be placed under some tension when the outer set 504 of lacings 910 become taught and rigid. In the embodiment where $L_2$ is greater than $L_1$, the inner set 502 of lacings 910 are useful for providing hand gripping away from the periphery 114 and 127 of the base 102 and top 104, respectively, and providing vertical support for personnel 408 on board as the system 900 is transferred. In the event of inadvertent impact from outside the system 900, any onboard personnel 408 will be shielded by the taught and rigid outer set 504 of lacings 910. When expander post 106 has been expanded such that there is a desired tension in the lacings 910, lower portion holes 170*a* are lined up with base coupler holes 164, and bolt 172 is placed in lower portion holes 170*a* and base coupler holes 164 to secure expander post 106 in base coupler 112 and tension in the lacings 910. In order to rotate the upper portion 140 of the expander post 106, in an exemplary embodiment, either the intermediate coupler 144 should be un-secured, unbolted, or unpinned from the lower portion 142 or the lower portion 142 should be unsecured, unbolted, or unpinned from the base coupler 112 to thereby allow relative rotation of the threaded portion 150 of upper portion 140 of expander post 106 and the top coupler 126 while still keeping the expander post vertically coupled to the base 102 and the top 104. After the threaded portion 150 is rotated sufficiently to expand the distance between the top 104 and base 102 to provide the desired tension in the lacings 108, the unsecured portions of expander post 106 should then be re-secured.

The lacings 910 are attached at corresponding base attachments 136 and 506*a* and top attachments 138 and 506*b* such that the lacings 910 are substantially parallel to each other when tension is applied to them. The lacings 910 are flexible when relaxed and become substantially rigid when tension is applied. The expander post 106 is activated to expand the space between the base 102 and the top 104 and to thereby apply tension to the lacings 910. The expander post 106 is sufficiently strong to impart a rigid connection between the base and the top and to impart significant tension to the lacings 910. For example, an aluminum tube having a nominal size of 4" schedule 80 has been found to work in one exemplary construction.

Figure 35:
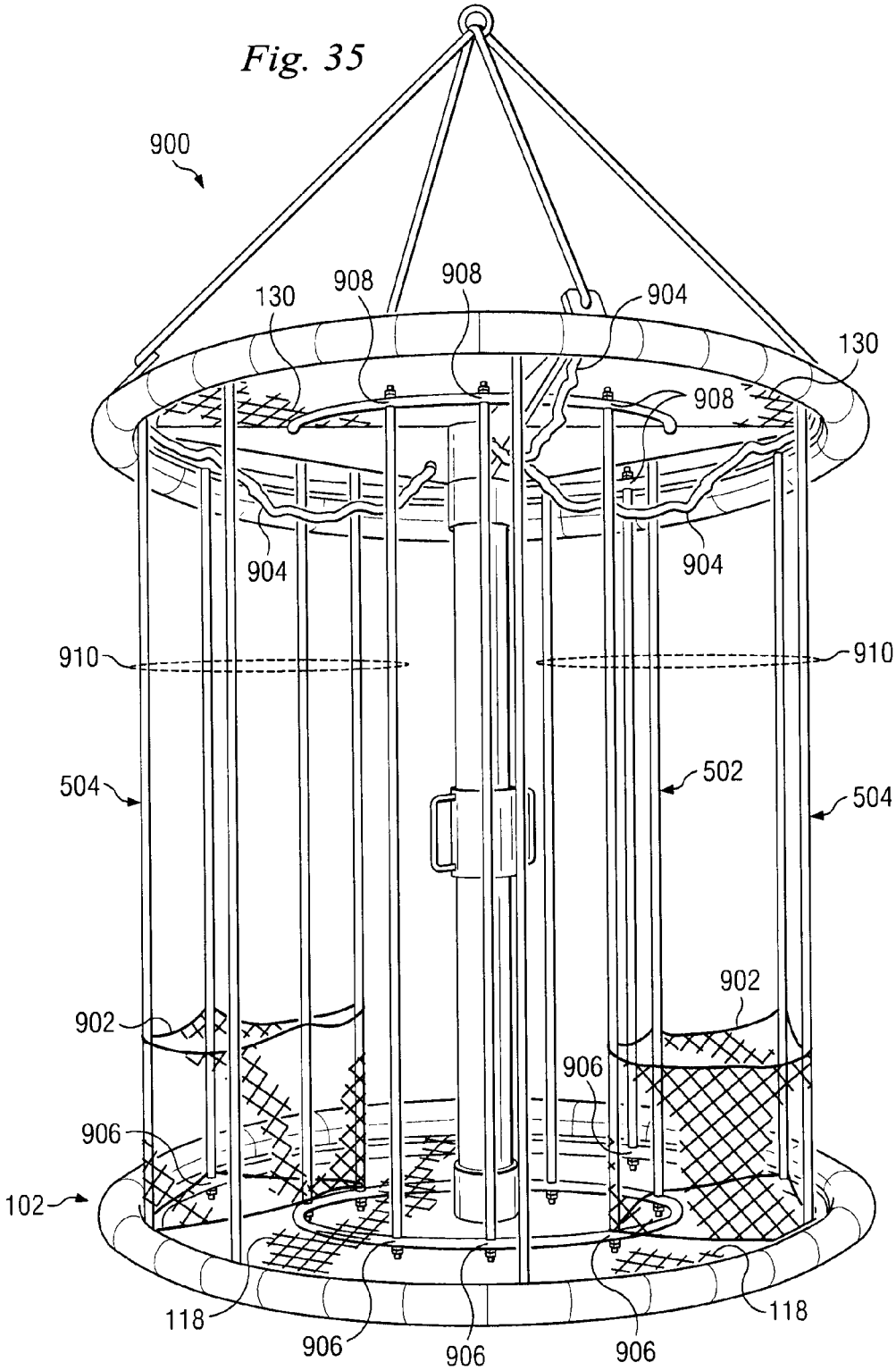
FIG. 35 is a perspective view illustrating an exemplary embodiment of a personnel transfer system.
Figure 36:
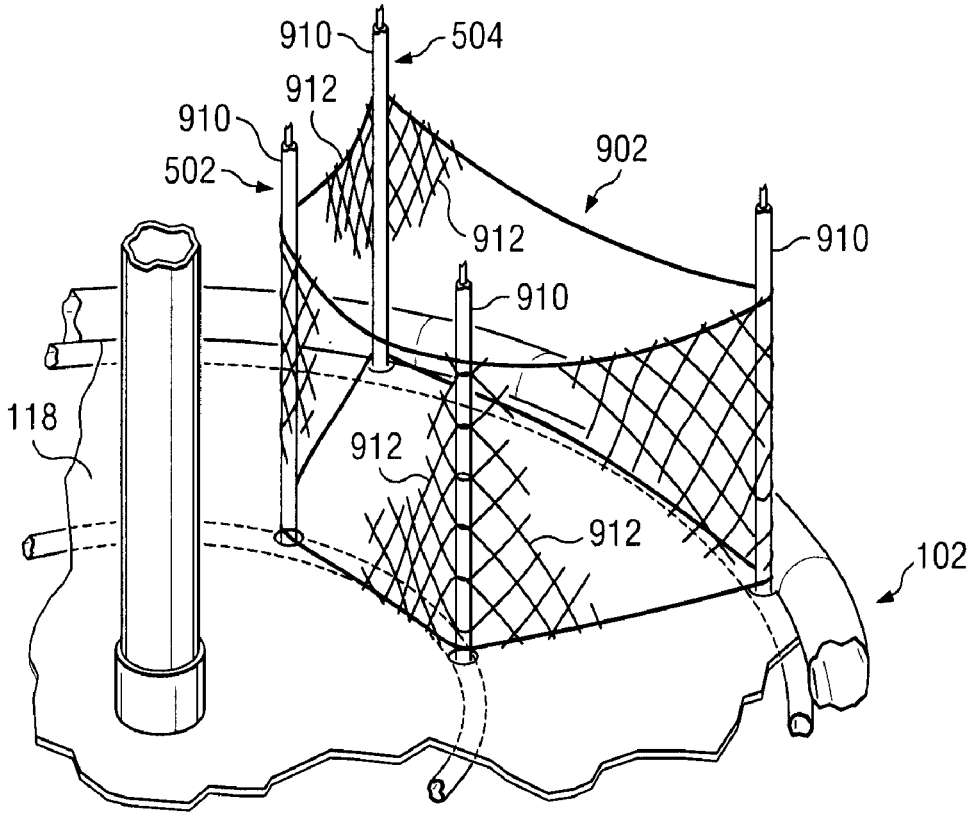
FIG. 36 is a perspective view illustrating a cargo basket on the personnel transfer system of FIG. 35.
Figure 37:
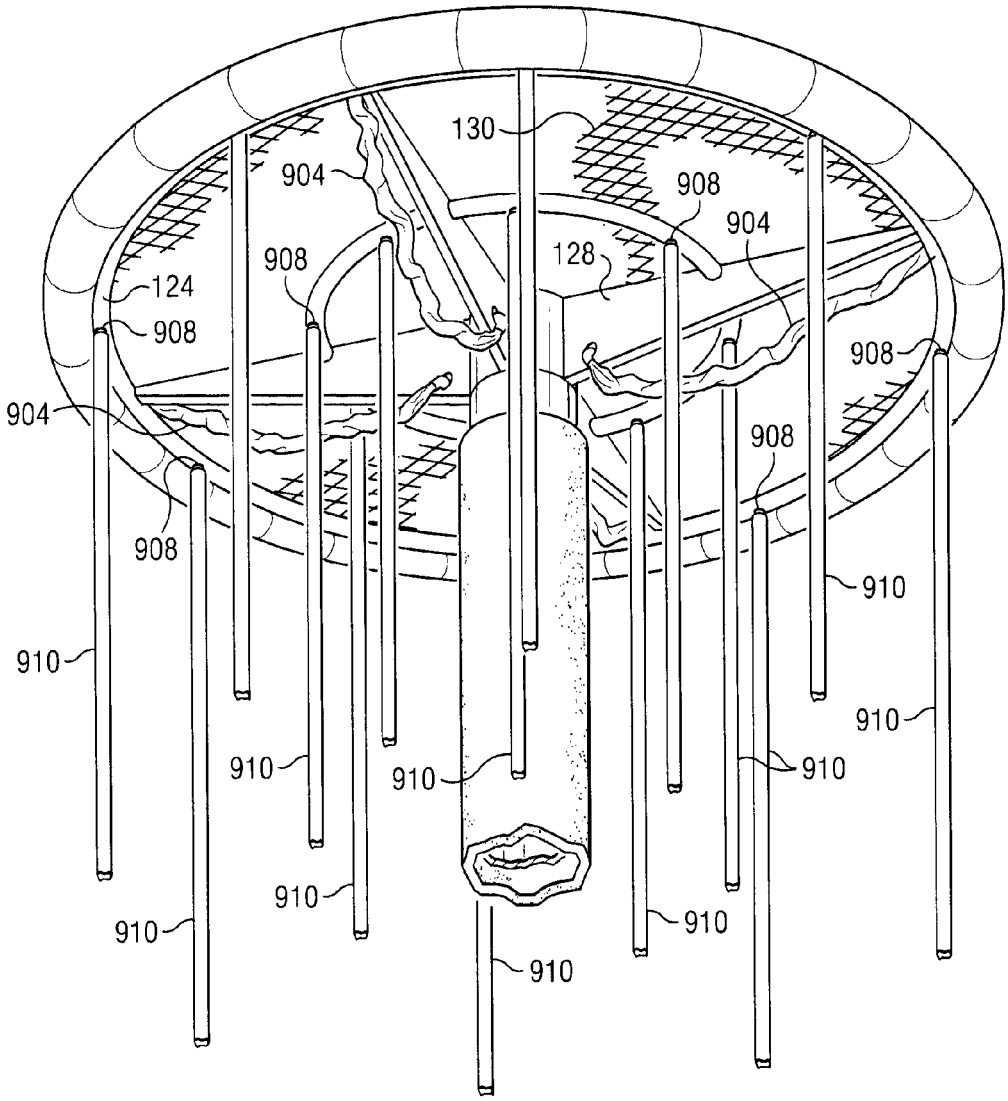
FIG. 37 is a perspective view illustrating a top section on the personnel transfer system of FIG. 35.
Figure 38:
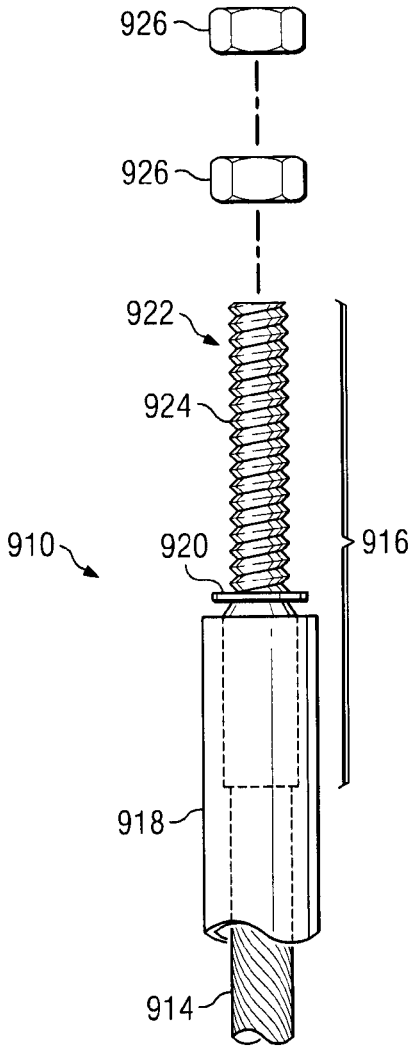
FIG. 38 is a side view illustrating an end of a lacing on the personnel transfer system of FIG. 35.
Figure 42:
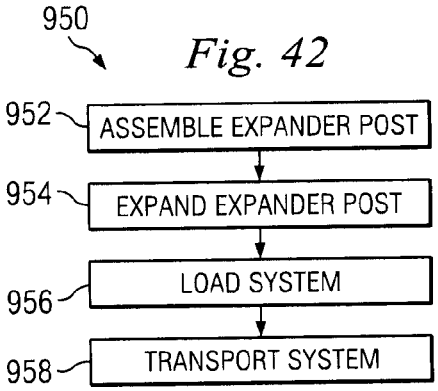
FIG. 42 is a schematic view illustrating an exemplary embodiment of a method for transporting personnel.

Referring to FIGS. 17, 35 and 42, in step 956, once the expander post 106 has been expanded and there is the desired tension in the lacings 108, the system 900 may be loaded with personnel 408. Cargo may be loaded in the cargo baskets 902. Lanyards 904 allow personnel 408 entering the system 900 the option of securing a tether line to the system. For example, the personnel 408 may be wearing a vest or a harness to which a quick release line may be provided for attaching to the lanyards 910. In one embodiment, the personnel 408 will be situated on the deck 410 of an offshore vessel 412. The hoist 400 with line 406 is attached to the system 900, and the system 900 is moved by the hoist 400 onto the deck 410 of the offshore vessel 412. The diameter $D_b$ is sufficiently large (for example 5' to 7' Dia.) to allow the personnel 408 to be carried on the platform 118. In an exemplary embodiment, the spreader ring 110, supports 116, and expander post 106 may be constructed from a strong light weight metal tubing, such as aluminum tubing, having a nominal size of 1-½" schedule 40 has been found to work in one exemplary construction. In an exemplary embodiment, the platform 118 may be constructed of an light weight sheet material having a non-slip surface, such as diamond plate or expanded-metal grating. All of the metal material may be constructed of the same metal to reduce the adverse effect of cathode/anode induced corrosion. Flotation paddle 120 has both significant buoyancy to help float the device and cushioning to reduce consequences from inadvertent side impact. The roof 130 allows personnel 408 loaded onto the system 900 to have protection from above when standing on the platform 118

Referring to FIGS. 17 and 42, in step 958, the system 900 may be transported. The hoist 400 lifts the system 900, which is loaded with personnel 408, and may move the personnel 408 to a desired location, such as the deck 402 of offshore vessel 404. In an exemplary embodiment, offshore vessel 412 may be a boat and offshore vessel 404 may be an offshore platform or rig.

A personnel transfer system has been described that includes a base, a top, a plurality of lacings extending between the base and top, and an expander post coupled between the base and top and operable to place tension in the plurality of lacings extending between the base and the top. In an exemplary embodiment, the system includes a hoist connection for attachment of the system to a hoist so that the system may be lifted to transfer personnel thereon. In an exemplary embodiment, the system includes a first coupling attached to the base for coupling of the expander post to the base, a second coupling attached to the top for coupling of the expander post to the top, and threads formed between at least one of the couplings and the expander post so that rotation of a portion of the expander post in one direction increases the distance between the base and the top to place tension on the lacings. In an exemplary embodiment, the base includes at least one base spreader ring and a support structure extending at least partially between the base spreader ring and the first coupling to support the first coupling from the base spreader ring. In an exemplary embodiment, the top includes at least one top spreader ring and a support structure extending at least partially between the top spreader ring and the second coupling to support the second coupling from the top spreader ring. In an exemplary embodiment, the plurality of lacings include at least three flexible lacings attached to the base and to the top at corresponding spaced apart locations, each lacing having substantially equal length between the base attachment location and the top attachment location so that tension in the lacings causes the top to be substantially parallel to the base. In an exemplary embodiment, the plurality of lacings include a set of outer flexible lacings attached to the base and to the top at corresponding spaced apart locations and being attached toward the periphery of the base and the periphery of the top, and a set of inner flexible lacings attached to the base and the top at corresponding locations and being attached toward the center of the base and the top. In an exemplary embodiment, the outer flexible lacings have substantially equal length between the base attachment location and the top attachment location so that tension in the lacings causes the top to be substantially parallel to the base, and the inner flexible lacings have a length between the base attachment location and the top attachment location that is at least as long as the length of the outer flexible lacings so that the base and the top remain parallel when any of the inner flexible lacings is also placed in tension. In an exemplary embodiment, the plurality of lacings include a set of outer lacings comprising an even number of at least four flexible lacings attached to the base and to the top at corresponding spaced apart locations toward the periphery of the base and the top, and a set of inner lacings comprising flexible lacings attached to the base and the top at corresponding locations being spaced toward the center of the base and the top. In an exemplary embodiment, the system includes each of the at least four outer lacings has substantially equal length between the base attachment location and the top attachment location so that tension in the outer lacings causes the top to be substantially parallel to the base, and each inner lacings has a length between the base attachment location and the top attachment location that is at least as long as the substantially equal length of the at least four outer lacings so that the base and the top remain parallel when any of the second set of lacings is also placed in tension. In an exemplary embodiment, the system includes cross-lacings between alternate pairs of the outer lacings so that personnel may enter the system through pairs of outer lacings without cross-lacings. In an exemplary embodiment, the set of inner lacings include an even number of at least four flexible lacings equal to the number of outer lacings and are attached adjacent to the outer lacings with cross-lacings between alternate pairs of inner lacings and radial-lacings between the inner and outer lacings so that personnel may enter the system through the pairs of outer lacings without cross-lacings and between the radial-lacings. In an exemplary embodiment, the system includes at least one cargo basket coupled to the plurality of lacings. In an exemplary embodiment, the system includes at least one lanyard coupled to the top. In an exemplary embodiment, the system includes a foot support coupled to the base.

A personnel transfer system has been described that includes a base, a top, a plurality of outer lacings extending between the base and top, the outer lacings attached to the base and the top at corresponding spaced apart locations and toward the periphery of the base and the periphery of the top, a plurality of inner lacings extending between the base and the top, the inner lacings attached to the base and top at corresponding locations and toward the center of the base and the center of the top, and an expander post coupled between the base and top and operable to place tension in the plurality of outer and inner lacings extending between the base and the top. In an exemplary embodiment, the system includes a hoist connection for attachment of the system to a hoist so that the system may be lifted to transfer personnel thereon. In an exemplary embodiment, the system includes a first coupling attached to the base for coupling of the expander post to the base, a second coupling attached to the top for coupling of the expander post to the top, and threads formed between at least one of the couplings and the expander post so that rotation of a portion of the expander post in one direction increases the distance between the base and the top to place tension on the lacings. In an exemplary embodiment, the base includes at least one base spreader ring and a support structure extending at least partially between the base spreader ring and the first coupling to support the first coupling from the base spreader ring. In an exemplary embodiment, the top includes at least one top spreader ring and a support structure extending at least partially between the top spreader ring and the second coupling to support the second coupling from the top spreader ring. In an exemplary embodiment, the plurality of outer lacings include at least three flexible lacings attached to the base and to the top at corresponding spaced apart locations, each lacing having substantially equal length between the base attachment location and the top attachment location so that tension in the lacings causes the top to be substantially parallel to the base. In an exemplary embodiment, the outer flexible lacings have substantially equal length between the base attachment location and the top attachment location so that tension in the lacings causes the top to be substantially parallel to the base, and the inner flexible lacings have a length between the base attachment location and the top attachment location that is at least as long as the length of the outer flexible lacings so that the base and the top remain parallel when any of the inner flexible lacings is also placed in tension. In an exemplary embodiment, the plurality of outer lacings include an even number of at least four flexible lacings attached to the base and to the top at corresponding spaced apart locations toward the periphery of the base and the top. In an exemplary embodiment, the at least four outer lacings has substantially equal length between the base attachment location and the top attachment location so that tension in the outer lacings causes the top to be substantially parallel to the base, and each inner lacings has a length between the base attachment location and the top attachment location that is at least as long as the substantially equal length of the at least four outer lacings so that the base and the top remain parallel when any of the second set of lacings is also placed in tension. In an exemplary embodiment, the system includes cross-lacings between alternate pairs of the outer lacings so that personnel may enter the system through pairs of outer lacings without cross-lacings. In an exemplary embodiment, the set of inner lacings include an even number of at least four flexible lacings equal to the number of outer lacings and are attached adjacent to the outer lacings with cross-lacings between alternate pairs of inner lacings and radial-lacings between the inner and outer lacings so that personnel may enter the system through the pairs of outer lacings without cross-lacings and between the radial-lacings. In an exemplary embodiment, the system includes at least one cargo basket coupled to the plurality of lacings. In an exemplary embodiment, the system includes at least one lanyard coupled to the top. In an exemplary embodiment, the system includes a foot support coupled to the base.

A personnel transfer system has been described that includes a base, a top, an even number of at least four outer lacings extending between the base and top, the outer lacings attached to the base and the top at corresponding spaced apart locations and toward the periphery of the base and the periphery of the top, an even number of at least four inner lacings extending between the base and the top, the inner lacings attached to the base and top at corresponding locations and toward the center of the base and the center of the top, a first set of cross lacings extending between alternate pairs of the outer lacings so that personnel may enter the system through pairs of outer lacings without cross-lacings, a second set of cross lacings extending between alternate pairs of the inner lacings corresponding to the alternate pairs of outer lacings with the first set of cross lacings extending between them, a set of radial lacings between the inner and outer lacings which have cross lacings extending between them, and an expander post coupled between the base and top and operable to place tension in the plurality of outer and inner lacings extending between the base and the top. In an exemplary embodiment, the system includes a hoist connection for attachment of the system to a hoist so that the system may be lifted to transfer personnel thereon. In an exemplary embodiment, the system includes a first coupling attached to the base for coupling of the expander post to the base, a second coupling attached to the top for coupling of the expander post to the top, and threads formed between at least one of the couplings and the expander post so that rotation of a portion of the expander post in one direction increases the distance between the base and the top to place tension on the lacings. In an exemplary embodiment, the base includes at least one base spreader ring and a support structure extending at least partially between the base spreader ring and the first coupling to support the first coupling from the base spreader ring. In an exemplary embodiment, the top includes at least one top spreader ring and a support structure extending at least partially between the top spreader ring and the second coupling to support the second coupling from the top spreader ring. In an exemplary embodiment, the outer flexible lacings have substantially equal length between the base attachment location and the top attachment location so that tension in the lacings causes the top to be substantially parallel to the base, and the inner flexible lacings have a length between the base attachment location and the top attachment location that is at least as long as the length of the outer flexible lacings so that the base and the top remain parallel when any of the inner flexible lacings is also placed in tension. In an exemplary embodiment, the system includes at least one cargo basket coupled to the plurality of lacings. In an exemplary embodiment, the system includes at least one lanyard coupled to the top. In an exemplary embodiment, the system includes a foot support coupled to the base.

An offshore vessel has been described that includes a hoist situated on the vessel and coupled to a hoist connection, and a personnel transfer system coupled to the hoist connection comprising a base, a top, a plurality of lacings extended between the base and the top, and an expander post coupled between the base and the top and operable to place tension in the plurality of lacings extending between the base and the top. In an exemplary embodiment, the vessel includes a first coupling attached to the base for coupling of the expander post to the base, a second coupling attached to the top for coupling of the expander post to the top, and threads formed between at least one of the couplings and the expander post so that rotation of a portion of the expander post in one direction increases the distance between the base and the top to place tension on the lacings. In an exemplary embodiment, the base includes at least one base spreader ring and a support structure extending at least partially between the base spreader ring and the first coupling to support the first coupling from the base spreader ring. In an exemplary embodiment, the top includes at least one top spreader ring and a support structure extending at least partially between the top spreader ring and the second coupling to support the second coupling from the top spreader ring. In an exemplary embodiment, the plurality of lacings include at least three flexible lacings attached to the base and to the top at corresponding spaced apart locations, each lacing having substantially equal length between the base attachment location and the top attachment location so that tension in the lacings causes the top to be substantially parallel to the base. In an exemplary embodiment, the plurality of lacings include a set of outer flexible lacings attached to the base and to the top at corresponding spaced apart locations and being attached toward the periphery of the base and the periphery of the top, and a set of inner flexible lacings attached to the base and the top at corresponding locations and being attached toward the center of the base and the top. In an exemplary embodiment, the outer flexible lacings have substantially equal length between the base attachment location and the top attachment location so that tension in the lacings causes the top to be substantially parallel to the base, and the inner flexible lacings have a length between the base attachment location and the top attachment location that is at least as long as the length of the outer flexible lacings so that the base and the top remain parallel when any of the inner flexible lacings is also placed in tension. In an exemplary embodiment, the plurality of lacings include a set of outer lacings comprising an even number of at least four flexible lacings attached to the base and to the top at corresponding spaced apart locations toward the periphery of the base and the top, and a set of inner lacings comprising flexible lacings attached to the base and the top at corresponding locations being spaced toward the center of the base and the top. In an exemplary embodiment, each of the at least four outer lacings has substantially equal length between the base attachment location and the top attachment location so that tension in the outer lacings causes the top to be substantially parallel to the base, and each inner lacings has a length between the base attachment location and the top attachment location that is at least as long as the substantially equal length of the at least four outer lacings so that the base and the top remain parallel when any of the second set of lacings is also placed in tension. In an exemplary embodiment, the vessel includes cross-lacings between alternate pairs of the outer lacings so that personnel may enter the system through pairs of outer lacings without cross-lacings. In an exemplary embodiment, the set of inner lacings includes an even number of at least four flexible lacings equal to the number of outer lacings and are attached adjacent to the outer lacings with cross-lacings between alternate pairs of inner lacings and radial-lacings between the inner and outer lacings so that personnel may enter the system through the pairs of outer lacings without cross-lacings and between the radial-lacings. In an exemplary embodiment, the vessel includes at least one cargo basket coupled to the plurality of lacings. In an exemplary embodiment, the vessel includes at least one lanyard coupled to the top. In an exemplary embodiment, the vessel includes at least three foot supports coupled to the base. In an exemplary embodiment, the vessel is situated on a body of water.

An offshore vessel has been described that includes a hoist situated on the vessel and coupled to a hoist connection, and a personnel transfer system coupled to the hoist connection comprising a base, a top, a plurality of outer lacings extending between the base and top, the outer lacings attached to the base and the top at corresponding spaced apart locations and toward the periphery of the base and the periphery of the top, a plurality of inner lacings extending between the base and the top, the inner lacings attached to the base and top at corresponding locations and toward the center of the base and the center of the top, and an expander post coupled between the base and top and operable to place tension in the plurality of outer and inner lacings extending between the base and the top. In an exemplary embodiment, the vessel includes a first coupling attached to the base for coupling of the expander post to the base, a second coupling attached to the top for coupling of the expander post to the top, and threads formed between at least one of the couplings and the expander post so that rotation of a portion of the expander post in one direction increases the distance between the base and the top to place tension on the lacings. In an exemplary embodiment, the base includes at least one base spreader ring and a support structure extending at least partially between the base spreader ring and the first coupling to support the first coupling from the base spreader ring. In an exemplary embodiment, the top includes at least one top spreader ring and a support structure extending at least partially between the top spreader ring and the second coupling to support the second coupling from the top spreader ring. In an exemplary embodiment, the plurality of outer lacings include at least three flexible lacings attached to the base and to the top at corresponding spaced apart locations, each lacing having substantially equal length between the base attachment location and the top attachment location so that tension in the lacings causes the top to be substantially parallel to the base. In an exemplary embodiment, the outer flexible lacings have substantially equal length between the base attachment location and the top attachment location so that tension in the lacings causes the top to be substantially parallel to the base, and the inner flexible lacings have a length between the base attachment location and the top attachment location that is at least as long as the length of the outer flexible lacings so that the base and the top remain parallel when any of the inner flexible lacings is also placed in tension. In an exemplary embodiment, the plurality of outer lacings include an even number of at least four flexible lacings attached to the base and to the top at corresponding spaced apart locations toward the periphery of the base and the top. In an exemplary embodiment, each of the at least four outer lacings has substantially equal length between the base attachment location and the top attachment location so that tension in the outer lacings causes the top to be substantially parallel to the base, and each inner lacings has a length between the base attachment location and the top attachment location that is at least as long as the substantially equal length of the at least four outer lacings so that the base and the top remain parallel when any of the second set of lacings is also placed in tension. In an exemplary embodiment, the vessel includes cross-lacings between alternate pairs of the outer lacings so that personnel may enter the system through pairs of outer lacings without cross-lacings. In an exemplary embodiment, the set of inner lacings include an even number of at least four flexible lacings equal to the number of outer lacings and are attached adjacent to the outer lacings with cross-lacings between alternate pairs of inner lacings and radial-lacings between the inner and outer lacings so that personnel may enter the system through the pairs of outer lacings without cross-lacings and between the radial-lacings. In an exemplary embodiment, the vessel includes at least one cargo basket coupled to the plurality of lacings. In an exemplary embodiment, the vessel includes at least one lanyard coupled to the top. In an exemplary embodiment, the vessel includes a foot support coupled to the base. In an exemplary embodiment, the vessel is situated on a body of water.

An offshore vessel has been described that includes a hoist situated on the vessel and coupled to a hoist connection, and a personnel transfer system coupled to the hoist connection comprising a base, a top, an even number of at least four outer lacings extending between the base and top, the outer lacings attached to the base and the top at corresponding spaced apart locations and toward the periphery of the base and the periphery of the top, an even number of at least four inner lacings extending between the base and the top, the inner lacings attached to the base and top at corresponding locations and toward the center of the base and the center of the top, a first set of cross lacings extending between alternate pairs of the outer lacings so that personnel may enter the system through pairs of outer lacings without cross-lacings, a second set of cross lacings extending between alternate pairs of the inner lacings corresponding to the alternate pairs of outer lacings with the first set of cross lacings extending between them, a set of radial lacings between the inner and outer lacings which have cross lacings extending between them, and an expander post coupled between the base and top and operable to place tension in the plurality of outer and inner lacings extending between the base and the top. In an exemplary embodiment, the vessel includes a first coupling attached to the base for coupling of the expander post to the base, a second coupling attached to the top for coupling of the expander post to the top, and threads formed between at least one of the couplings and the expander post so that rotation of a portion of the expander post in one direction increases the distance between the base and the top to place tension on the lacings. In an exemplary embodiment, the base includes at least one base spreader ring and a support structure extending at least partially between the base spreader ring and the first coupling to support the first coupling from the base spreader ring. In an exemplary embodiment, the top includes at least one top spreader ring and a support structure extending at least partially between the top spreader ring and the second coupling to support the second coupling from the top spreader ring. In an exemplary embodiment, the outer flexible lacings have substantially equal length between the base attachment location and the top attachment location so that tension in the lacings causes the top to be substantially parallel to the base, and the inner flexible lacings have a length between the base attachment location and the top attachment location that is at least as long as the length of the outer flexible lacings so that the base and the top remain parallel when any of the inner flexible lacings is also placed in tension. In an exemplary embodiment, the vessel includes at least one cargo basket coupled to the plurality of lacings. In an exemplary embodiment, the vessel includes at least one lanyard coupled to the top. In an exemplary embodiment, the vessel includes a foot support coupled to the base. In an exemplary embodiment, the vessel is situated on a body of water.

A method for transferring personnel has been described that includes providing a base, providing a top, providing a hoist connection coupled to the top, extending a plurality of lacings between the base and top, coupling an expander post between the base and top, expanding the expander post, whereby expansion of the expander post puts the plurality of lacings in tension, coupling a hoist to the hoist connection, situating at least one personnel on the base, and moving the hoist. In an exemplary embodiment, the method includes protecting the at least one personnel with the plurality of lacings in tension.

A method for transferring personnel has been described that includes providing an offshore vessel, situating a hoist on the vessel, coupling the hoist to a hoist connection, coupling the top to the hoist connection, coupling a base to the top, extending a plurality of lacings between the base and top, coupling an expander post between the base and top, expanding the expander post, whereby expansion of the expander post puts the plurality of lacings in tension, situating at least one personnel on the base, and moving the hoist. In an exemplary embodiment, the method includes protecting the at least one personnel with the plurality of lacings in tension.

A personnel transfer system has been described that includes a base, a top, a plurality of lacings extending between the base and top, and means coupled between the base and top for placing tension in the plurality of lacings extending between the base and the top. In an exemplary embodiment, the system includes a means for attachment of the system to a lifting means, the lifting means for lifting the system to transfer personnel thereon. In an exemplary embodiment, the system includes a means attached to the base for coupling the means for placing tension in the plurality of lacings to the base, and a means attached to the top for coupling of the means for placing tension in the plurality of lacings to the top. In an exemplary embodiment, the base includes at least one means for supporting the means attached to the base for coupling the means for placing tension in the plurality of lacings to the base. In an exemplary embodiment, the top includes at least one means for supporting the means attached to the top for coupling of the means for placing tension in the plurality of lacings to the top. In an exemplary embodiment, the plurality of lacings include at least three flexible lacings attached to the base and to the top at corresponding spaced apart locations, each lacing having a means for holding the top substantially parallel to the base when the plurality of lacings are put in tension. In an exemplary embodiment, the plurality of lacings include a set of outer flexible lacings attached to the base and to the top at corresponding spaced apart locations and being attached toward the periphery of the base and the periphery of the top, and a set of inner flexible lacings attached to the base and the top at corresponding locations and being attached toward the center of the base and the top. In an exemplary embodiment, the outer flexible lacings have a means for holding the top substantially parallel to the base when the outer flexible lacings are put in tension, and the inner flexible lacings have having a means for holding the top substantially parallel to the base when the plurality of lacings are put in tension. In an exemplary embodiment, the plurality of lacings include a set of outer lacings comprising an even number of at least four flexible lacings attached to the base and to the top at corresponding spaced apart locations toward the periphery of the base and the top, and a set of inner lacings comprising flexible lacings attached to the base and the top at corresponding locations being spaced toward the center of the base and the top. In an exemplary embodiment, each of the at least four outer lacings have a means for holding the top substantially parallel to the base when the plurality of lacings are put in tension, and each inner lacings have a means for holding the top substantially parallel to the base when the plurality of lacings are put in tension. In an exemplary embodiment, the system includes means for connecting alternate pairs of the outer lacings to allow personnel to enter the system through pairs of outer lacings without the means for connecting alternate pairs of the outer lacings. In an exemplary embodiment, the set of inner lacings include an even number of at least four flexible lacings equal to the number of outer lacings and include a means for connecting alternate pairs of inner lacings and a means for connecting pairs of the inner lacings to outer lacings. In an exemplary embodiment, the system includes means for storing cargo coupled to the plurality of lacings. In an exemplary embodiment, the system includes means for attaching a safety line coupled to the top. In an exemplary embodiment, the system includes means for supporting the system coupled to the base.

According to another aspect of the present invention, a method for manufacturing a personnel transfer system is provided that includes providing a base, providing a top, extending a plurality of lacings between the base and top, coupling an expander post between the base and top, and expanding the expander post, whereby expansion of the expander post puts the plurality of lacings in tension.

According to another aspect of the present invention, a method for transferring personnel is provided that includes providing a base, providing a top including a hoist connection, extending a plurality of lacings between the base and top, coupling an expander post between the base and top, expanding the expander post, whereby expansion of the expander post puts the plurality of lacings in tension, attaching a hoist to the hoist connection, situating at least one personnel on the base, moving the hoist, protecting the personnel from above with the top, and protecting the personnel from the sides with the plurality of lacings in tension.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, a plurality of lacings extending between the top and the base and attached to the top and the base at corresponding spaced apart locations adjacent the periphery of the top and adjacent the periphery of the base, and an expander post coupled to the top coupler and the base coupler, the expander post operable to place tension in the plurality of lacings extending between the base and the top.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, a plurality of outer lacings extending between the top and the base and attached to the top and the base at corresponding spaced apart locations adjacent the periphery of the top and adjacent the periphery of the base, a plurality of inner lacings extending between the top and the base and attached to the top and the base at corresponding locations between the center of the top and between the center of the base, and an expander post coupled to the top coupler and the base coupler, the expander post operable to place tension in the plurality of lacings extending between the base and the top.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, an even number of at least four outer lacings extending between the top and the base and attached to the top and the base at corresponding spaced apart locations adjacent the periphery of the top and adjacent the periphery of the base, a plurality of outer cross lacings extending between alternating pairs of the at least four outer lacings, whereby personnel may enter the system through pairs of outer lacings without outer cross-lacings, an even number of at least four inner lacings extending between the top and the base and attached to the top and the base at corresponding locations between the center of the top and between the center of the base, a plurality of inner cross lacings extending between alternating pairs of the at least four inner lacings, whereby personnel may enter the system through pairs of inner lacings without inner cross-lacings, a plurality of radial lacings extending between the inner lacings and the outer lacings, and an expander post coupled to the top coupler and the base coupler, the expander post operable to place tension in the plurality of lacings extending between the base and the top.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a plurality of lanyards coupled to the top, a base including a platform and a base periphery, a base support structure coupled to the base, a buoyant padding covering the base periphery, a base coupler coupled to the base support structure, an even number of at least four outer lacings extending between the top and the base and attached to the top and the base at corresponding spaced apart locations adjacent the periphery of the top and adjacent the periphery of the base, a plurality of upper outer cross lacings extending between alternating pairs of the at least four outer lacings, whereby personnel may enter the system through pairs of outer lacings without upper outer cross-lacings, a plurality of lower outer cross lacings extending between alternating pairs of the at least four outer lacings, whereby personnel may enter the system through pairs of outer lacings without lower outer cross-lacings, an even number of at least four inner lacings extending between the top and the base and attached to the top and the base at corresponding locations between the center of the top and between the center of the base, a plurality of upper inner cross lacings extending between alternating pairs of the at least four inner lacings, whereby personnel may enter the system through pairs of inner lacings without upper inner cross-lacings, a plurality of lower inner cross lacings extending between alternating pairs of the at least four inner lacings, whereby personnel may enter the system through pairs of inner lacings without lower inner cross-lacings, a plurality of radial lacings extending between the inner lacings and the outer lacings, and an expander post coupled to the top coupler and the base coupler, the expander post operable to place tension in the plurality of lacings extending between the base and the top.

According to another aspect of the present invention, a personnel transfer system is provided that includes a top including a roof and a top periphery, a hoist connection coupled to the top, a top support structure coupled to the top, a top coupler coupled to the top support structure, a buoyant padding covering the top periphery, a plurality of lanyards coupled to the top, a base including a platform and a base periphery, a base support structure coupled to the base, a buoyant padding covering the base periphery, a base coupler coupled to the base support structure, a plurality of outer lacings extending between the top and the base and attached to the top and the base at corresponding spaced apart locations adjacent the periphery of the top and adjacent the periphery of the base, a plurality of inner lacings extending between the top and the base and attached to the top and the base at corresponding locations between the center of the top and between the center of the base, at least one cargo net extending between the inner lacings and the outer lacings, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a top including a roof and a top periphery, a top support structure coupled to the top, a top coupler coupled to the top support structure, a buoyant padding covering the top periphery, a base coupled to the top, the base including a platform and a base periphery, a base support structure coupled to the base, a buoyant padding covering the base periphery, a base coupler coupled to the base support structure, a plurality of lacings extending between the top and the base and attached to the top and the base at corresponding spaced apart locations adjacent the periphery of the top and adjacent the periphery of the base, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, a plurality of outer lacings extending between the top and the base and attached to the top and the base at corresponding spaced apart locations adjacent the periphery of the top and adjacent the periphery of the base, a plurality of inner lacings extending between the top and the base and attached to the top and the base at corresponding locations between the center of the top and between the center of the base, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a top including a roof and a top periphery, a hoist connection coupled to the top, a top support structure coupled to the top, a top coupler coupled to the top support structure, a buoyant padding covering the top periphery, a base including a platform and a base periphery, a base support structure coupled to the base, a buoyant padding covering the base periphery, a base coupler coupled to the base support structure, an even number of at least four outer lacings extending between the top and the base and attached to the top and the base at corresponding spaced apart locations adjacent the periphery of the top and adjacent the periphery of the base, a plurality of outer cross lacings extending between alternating pairs of the at least four outer lacings, whereby personnel may enter the system through pairs of outer lacings without outer cross-lacings, an even number of at least four inner lacings extending between the top and the base and attached to the top and the base at corresponding locations between the center of the top and between the center of the base, a plurality of inner cross lacings extending between alternating pairs of the at least four inner lacings, whereby personnel may enter the system through pairs of inner lacings without inner cross-lacings, a plurality of radial lacings extending between the inner lacings and the outer lacings, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising, a top including a roof and a top periphery, a hoist connection coupled to the top, a top support structure coupled to the top, a top coupler coupled to the top support structure, a buoyant padding covering the top periphery, a plurality of lanyards coupled to the top, a base including a platform and a base periphery, a base support structure coupled to the base, a buoyant padding covering the base periphery, a base coupler coupled to the base support structure, an even number of at least four outer lacings extending between the top and the base and attached to the top and the base at corresponding spaced apart locations adjacent the periphery of the top and adjacent the periphery of the base, a plurality of upper outer cross lacings extending between alternating pairs of the at least four outer lacings, whereby personnel may enter the system through pairs of outer lacings without upper outer cross-lacings, a plurality of lower outer cross lacings extending between alternating pairs of the at least four outer lacings, whereby personnel may enter the system through pairs of outer lacings without lower outer cross-lacings, an even number of at least four inner lacings extending between the top and the base and attached to the top and the base at corresponding locations between the center of the top and between the center of the base, a plurality of upper inner cross lacings extending between alternating pairs of the at least four inner lacings, whereby personnel may enter the system through pairs of inner lacings without upper inner cross-lacings, a plurality of lower inner cross lacings extending between alternating pairs of the at least four inner lacings, whereby personnel may enter the system through pairs of inner lacings without lower inner cross-lacings, a plurality of radial lacings extending between the inner lacings and the outer lacings, and an expander post coupled to the top coupler and the base coupler, the expander post operable to place tension in the plurality of lacings extending between the base and the top.

According to another aspect of the present invention, an offshore vessel is provided that includes a hoist situated on the vessel and coupled to a hoist connection, and a personnel transfer system coupled to the hoist connection comprising a top including a roof and a top periphery, a hoist connection coupled to the top, a top support structure coupled to the top, a top coupler coupled to the top support structure, a buoyant padding covering the top periphery, a plurality of lanyards coupled to the top, a base including a platform and a base periphery, a base support structure coupled to the base, a buoyant padding covering the base periphery, a base coupler coupled to the base support structure, a plurality of outer lacings extending between the top and the base and attached to the top and the base at corresponding spaced apart locations adjacent the periphery of the top and adjacent the periphery of the base, a plurality of inner lacings extending between the top and the base and attached to the top and the base at corresponding locations between the center of the top and between the center of the base, at least one cargo net extending between the inner lacings and the outer lacings, and an expander post coupled to the top coupler and the base coupler, the expander post operable to place tension in the plurality of lacings extending between the base and the top.

According to another aspect of the present invention, a method for transferring personnel is provided that includes providing a base, providing a top, coupling a hoist connection to the top, extending a plurality of lacings between the base and top, coupling an expander post between the base and top, expanding the expander post, whereby expansion of the expander post puts the plurality of lacings in tension, coupling a hoist to the hoist connection, situating at least one personnel on the base, protecting the at least one personnel with the plurality of lacings in tension, and moving the hoist.

According to another aspect of the present invention, a method for transferring personnel is provided that includes providing an offshore vessel, situating a hoist on the vessel, coupling the hoist to a hoist connection, coupling the top to the hoist connection, coupling a base to the top, extending a plurality of lacings between the base and top, coupling an expander post between the base and top, expanding the expander post, whereby expansion of the expander post puts the plurality of lacings in tension, situating at least one personnel on the base, protecting the at least one personnel with the plurality of lacings in tension, and moving the hoist.

According to another aspect of the present invention, a personnel transfer system is provided that includes a top including a roof and a top periphery, means for attaching to a lifting mechanism coupled to the top, a top support structure coupled to the top, a first means for coupling coupled to the top support structure, means for providing buoyancy and shock absorption covering the top periphery, a base including a platform and a base periphery, a base support structure coupled to the base, means for providing buoyancy and shock absorption covering the base periphery, a second means for coupling coupled to the base support structure, a plurality of lacings extending between the top and the base and attached to the top and the base at corresponding spaced apart locations adjacent the periphery of the top and adjacent the periphery of the base, and means for providing tension in the plurality of lacings coupled to the first means for coupling and the second means for coupling.

VARIATIONS AND EQUIVALENTS

It is understood that variations may be made in the foregoing without departing from the scope of the invention. For example, terms with directional connotations such as base, top, upper, lower, outer, and inner are used in context for purposes of relative positions and the device need not be limited to absolute directions in order to fall within the scope of the invention described and claimed. While various features and embodiments are described in certain combinations and sub-combinations selected features from one embodiment may be combined with features of other embodiments without departing from certain aspects of the invention.

The lacings 108 and 910 may alternatively be constructed of successive layers of polyurethane, fiberglass resin, and polypropylene rope, as described in U.S. Pat. No. 4,789,045, incorporated herein by reference. Other means for attachment and other types of lacings that are flexible when relaxed and strong and substantially "rigid" in tension may be employed without departing from certain aspects of the invention.

The expander post may be another means for expanding the distance between the base and the top to tension the lacings 108 and 910. In an alternative embodiment, the activation into expansion as described with regard to methods 300, 550, 650, 750, 850 and 950 as shown in FIGS. 16, 22, 25, 27, 34, and 42 may be a cam actuated device, a hydraulically actuated expansion device, or an electrically actuated expansion device, without departing from certain aspects of the invention.

The securing means are shown as bolts but may be other removable fastener devices without varying from certain aspects of the invention.

The construction is shown as aluminum but could be other construction with sufficient strength and durability.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as described and to which applicants may be entitled.

What is claimed is:

1. A method for transferring personnel comprising:
providing a base;
providing a top:
providing a hoist connection coupled to the top;
extending a plurality of concentric lacings between the base and top, the lacings including:
a set of outer lacings comprising at least three flexible lacings of substantially equal length attached to the base and to the top at corresponding spaced apart locations and being attached toward the periphery of the base and the periphery of the top so that tension in the outer lacings causes the top to be substantially parallel to the base; and
a set of inner lacings comprising flexible lacings attached to the base and the top at corresponding locations being spaced toward the center of the base and the top, and each inner lacing having a length between the base attachment location and the top attachment location that is at least as long as the substantially equal length of the at least three outer lacings so that the base and the top remain parallel when any of the set of inner lacings is also placed in tension;
coupling an expander post between the base and top;
expanding the expander post, whereby expansion of the expander post puts the plurality of lacings in tension;
coupling a hoist to the hoist connection;
situating at least one personnel on the base; and
moving the hoist.

2. The method of claim 1 further comprising:
protecting the at least one personnel with the plurality of lacings in tension.

3. A method of transferring personnel comprising:
providing an offshore vessel;
situating a hoist on the vessel;
coupling the hoist to a hoist connection;
coupling the top to the hoist connection;
coupling a base to the top;
extending a plurality of concentric lacings between the base and top, the lacings including:
a set of outer lacings comprising at least three flexible lacings of substantially equal length attached to the base and to the top at corresponding spaced apart locations and being attached toward the periphery of the base and the periphery of the top so that tension in the outer lacings causes the top to be substantially parallel to the base; and
a set of inner lacings comprising flexible lacings attached to the base and the top at corresponding locations being spaced toward the center of the base and the top, and each inner lacing having a length between the base attachment location and the top attachment location that is at least as long as the substantially equal length of the at least three outer lacings so that the base and the top remain parallel when any of the set of inner lacings is also placed in tension;
coupling an expander post between the base and top;
expanding the expander post, whereby expansion of the expander post puts the plurality of lacings in tension;
situating at least one personnel on the base; and moving the hoist.

4. The method of claim 3 further comprising:
protecting the at least one personnel with the plurality of lacings in tension.

5. A method of manufacturing a personnel transfer system comprising:
providing a base;
providing a top;
extending a plurality of concentric lacings between the base and top, the lacings including:
a set of outer lacings comprising at least three flexible lacings of substantially equal length attached to the base and to the top at corresponding spaced apart locations and being attached toward the periphery of the base and the periphery of the top so that tension in the outer lacings causes the top to be substantially parallel to the base; and
a set of inner lacings comprising flexible lacings attached to the base and the top at corresponding locations being spaced toward the center of the base and the top, and each inner lacing having a length between the base attachment location and the top attachment location that is at least as long as the substantially equal length of the at least three outer lacings so that the base and the top remain parallel when any of the set of inner lacings is also placed in tension;
coupling an expander post between the base and top; and
expanding the expander post, whereby expansion of the expander post puts the plurality of lacings in tension.

6. A method for transferring personnel comprising:
providing a base;
providing a top including a hoist connection;
extending a plurality of concentric lacings between the base and top, the lacings including:

a set of outer lacings comprising at least three flexible lacings of substantially equal length attached to the base and to the top at corresponding spaced apart locations and being attached toward the periphery of the base and the periphery of the top so that tension in the outer lacings causes the top to be substantially parallel to the base; and a set of inner lacings comprising flexible lacings attached to the base and the top at corresponding locations being spaced toward the center of the base and the top, and each inner lacing having a length between the base attachment location and the top attachment location that is at least as long as the substantially equal length of the at least three outer lacings so that the base and the top remain parallel when any of the set of inner lacings is also placed in tension;

coupling an expander post between the base and top;

expanding the expander post, whereby expansion of the expander post puts the plurality of lacings in tension;

attaching a hoist to the hoist connection;

situating at least one personnel on the base;

moving the hoist;

protecting the personnel from above with the top; and protecting the personnel from the sides with the plurality of lacings in tension.

7. A method for transferring personnel comprising:

providing a base;

providing a top;

coupling a hoist connection to the top;

extending a plurality of concentric lacings between the base and top, the lacings including:

a set of outer lacings comprising at least three flexible lacings of substantially equal length attached to the base and to the top at corresponding spaced apart locations and being attached toward the periphery of the base and the periphery of the top so that tension in the outer lacings causes the top to be substantially parallel to the base; and a set of inner lacings comprising flexible lacings attached to the base and the top at corresponding locations being spaced toward the center of the base and the top, and each inner lacing having a length between the base attachment location and the top attachment location that is at least as long as the substantially equal length of the at least three outer lacings so that the base and the top remain parallel when any of the set of inner lacings is also placed in tension;

coupling an expander post between the base and top;

expanding the expander post, whereby expansion of the expander post puts the plurality of lacings in tension;

coupling a hoist to the hoist connection;

situating at least one personnel on the base;

protecting the at least one personnel with the plurality of lacings in tension; and moving the hoist.

8. A method of transferring personnel comprising:

providing an offshore vessel;

situating a hoist on the vessel;

coupling the hoist to a hoist connection;

coupling the top to the hoist connection;

coupling a base to the top;

extending a plurality of concentric lacings between the base and top, the lacings including:

a set of outer lacings comprising at least three flexible lacings of substantially equal length attached to the base and to the top at corresponding spaced apart locations and being attached toward the periphery of the base and the periphery of the top so that tension in the outer lacings causes the top to be substantially parallel to the base; and a set of inner lacings comprising flexible lacings attached to the base and the top at corresponding locations being spaced toward the center of the base and the top, and each inner lacing having a length between the base attachment location and the top attachment location that is at least as long as the substantially equal length of the at least three outer lacings so that the base and the top remain parallel when any of the set of inner lacings is also placed in tension;

coupling an expander post between the base and top;

expanding the expander post, whereby expansion of the expander post puts the plurality of lacings in tension;

situating at least one personnel on the base;

protecting the at least one personnel with the plurality of lacings in tension; and moving the hoist.

* * * * *

UNITED STATES PATENT AND TRADEMARK OFFICE

CERTIFICATE OF CORRECTION

PATENT NO. : 7,252,315 B2
APPLICATION NO. : 10/839104
DATED : August 7, 2007
INVENTOR(S) : Frank Liberato et al.

It is certified that error appears in the above-identified patent and that said Letters Patent is hereby corrected as shown below:

Title page item [57] in the Abstract; first sentence after the word is; delete “rrovided” and insert --provided--.

Signed and Sealed this

Thirtieth Day of June, 2009

JOHN DOLL
*Acting Director of the United States Patent and Trademark Office*